US005098557A

United States Patent [19]

Hirschler et al.

[11] Patent Number: 5,098,557

[45] Date of Patent: Mar. 24, 1992

[54] GRANULAR MATERIAL CLEANING APPARATUS AND METHOD

[76] Inventors: Dan E. Hirschler, 767 Valley View, Wichita, Kans. 67212; Glenn D. Wells, Rte. 2, Box 265, Hillsboro, Kans. 67063

[21] Appl. No.: 478,214

[22] Filed: Feb. 9, 1990

[51] Int. Cl.[5] ..... B07B 9/00

[52] U.S. Cl. ..... 209/29; 209/244; 209/240; 209/312; 209/356; 209/387

[58] Field of Search ..... 209/312, 28, 29, 356, 209/321, 318, 243, 244, 246, 247, 254, 387, 21, 22, 23, 30, 31, 36, 37, 240

[56] References Cited

U.S. PATENT DOCUMENTS

| | | | |
|---|---|---|---|
| 251,883 | 1/1882 | Holmes | 209/356 |
| 343,324 | 6/1886 | Kaspar | 209/356 |
| 675,057 | 5/1901 | Edison | 209/243 |
| 766,623 | 8/1904 | Huntley | 209/356 |
| 818,944 | 4/1906 | Eaches | 209/356 |
| 940,212 | 11/1909 | Stone | 209/356 |
| 987,460 | 3/1911 | Heldman | 209/28 |
| 2,087,464 | 7/1937 | Ayers | 55/430 X |
| 2,100,738 | 11/1937 | Frevert | 209/30 |
| 2,203,152 | 6/1940 | Johnson | 209/356 |
| 3,548,142 | 4/1951 | Carter | 209/312 X |
| 3,970,549 | 7/1976 | Ennis et al. | 209/399 |
| 4,152,255 | 5/1979 | Musschoot | 209/257 X |
| 4,535,895 | 8/1985 | Takiguchi et al. | 209/910 X |
| 4,880,530 | 11/1989 | Frey | 209/380 |
| 5,013,343 | 5/1991 | Miyamoto | 55/432 |

FOREIGN PATENT DOCUMENTS

| | | | |
|---|---|---|---|
| 3504994 | 8/1986 | Fed. Rep. of Germany | 209/254 |
| 919756 | 4/1982 | U.S.S.R. | 209/28 |

*Primary Examiner*—Donald T. Hajec
*Attorney, Agent, or Firm*—John Wade Carpenter

[57] ABSTRACT

A granular material cleaning apparatus and method. The apparatus has an upright container housing assembly; an inlet housing assembly pivotally connected to the upright container housing assembly to receive a contaminated granular material; and material inlet control assembly mounted to the upright container housing at an upper inlet portion thereof. A discharge housing assembly is mounted to the upright container housing assembly; and a material flow channel assembly is mounted within the container housing assembly generally underneath the material inlet control assembly to initially receive the contaminated granular material at an upper end thereof and pass the same under gravity moving transversely on the material flow channel assembly until discharged into the discharge housing assembly. The cleaning apparatus further comprises a fluid flow assembly mounted on the upright container housing and in communication with the inside of said upright container housing and in communication with the inside of the uprigbt container housing and operably to supply air flow.

11 Claims, 16 Drawing Sheets

GRANULAR MATERIAL CLEANING APPARATUS AND METHOD

BACKGROUND OF THE INVENTION

This invention relates to a new and novel granular material cleaning apparatus and process used to separate foreign material and debris from granular material such as wheat, milo, oats, and the like. The applicant herein is aware of what is available in the prior art structures and this invention appears to be a substantial improvement thereover. Therefore, a patentability investigation was not conducted on this invention.

This invention relates to a granular material cleaning apparatus operable to receive granular material into an upper end thereof for flow therethrough under the force of gravity and involves several steps through agitating and screening structures and use of fluid flow, such as air, so as to remove the impurities from the granular material and deposit the subsequent cleansed granular material at a lower exit portion.

SUMMARY OF THE INVENTION

In one preferred embodiment of this invention, a granular material cleaning apparatus and process is operable to receive a contaminated granular material such as wheat, barley, oats, milo, etc. and have the same flow from an upper entrance portion downwardly through a material flow channel assembly in order to remove debris and foreign material therefrom before exiting at a lower end as cleansed material into a storage or conveyance structure. The granular material cleaning apparatus includes (1) an upright main container housing assembly; (2) a material flow channel assembly mounted within the container housing assembly to control and direct granular material flow therewithin; (3) a material inlet control assembly mounted in an upper inlet portion of the container housing assembly to aid in the controlled initial movement of the granular material; (4) a fluid flow assembly mounted within the container housing assembly operable to provide a flow of fluid such as air therethrough to act as a conveyance medium to aid in the removal of debris and foreign material from the granular material flowing therethrough; and (5) a screen agitator assembly operably connected to the material flow channel assembly within the container housing assembly so as to aid in the agitation and removal of the debris and foreign material from the granular material. The main container housing assembly includes (1) an inlet housing assembly to receive and direct the inlet granular material; (2) an upright, elongated separator housing assembly connected to and adapted to receive granular material from the inlet housing assembly; (3) a discharge housing assembly connected to a lower portion of the separator housing assembly to receive the cleaned granular material therefrom; and (4) a main support housing assembly or a trailer to provide vertical support to the entire container housing assembly. The material flow channel assembly includes a first inlet support and filter assembly to receive the granular material at the inlet housing assembly; an intermediate support filter assembly to receive the initially cleaned granular material from the first inlet support and filter assembly; and a discharge support and filter assembly connected to a discharge portion of the intermediate support and filter assembly in order to receive the granular material for a final cleaning action before discharging into the discharge housing assembly. All of these above-identified support and filter assemblies are provided with grid type screen members mounted on respective support and containment frames. The fluid flow assembly includes a power fan assembly operable to create air flow within the material flow channel assembly so as to pick up the lighter weight debris and foreign material and remove same from the granular material. A separation zone is provided between the main container housing assembly and the power fan. The separation zone is preferably a cyclone for separating light contaminants from the fluid or air leaving the main container housing assembly. The screen agitator assembly includes brushing the respective screen members within the material flow channel assembly. Also, a new and novel separation process through the granular material cleaner apparatus of this invention involves the steps of (1) initially receiving and controlling the flow of contaminated granular material; (2) moving the granular material transversely over screen members to separate the foreign material thereupon; (3) agitating the respective screen members to separate the foreign material from the granular material; (4) utilizing air flow to pick up the separated foreign material and remove it from the granular material; and (5) depositing the cleansed granular material into a discharge hopper and moving the foreign material out of the main container housing assembly with a pair of augers. The process further comprises separating light contaminants from the air after the same leaves the main container housing assembly.

OBJECTS OF THE INVENTION

One object of this invention is to provide a granular material cleaning apparatus which can be mounted as portable on a truck or trailer bed or permanently installed which provides a vertically extended container housing assembly whereupon a contaminated granular material is fed into an upper inlet end through a amterial flow channel assembly utilizing air flow and an agitation process to remove the debris and foreign material from the granular material flowing therethrough under gravity.

Another object of this invention is to provide a granular material cleaning apparatus which can be mounted on a flat truck bed and utilized as a portable grain cleaner structure to be moved from one location to another in order to provide a granular material cleaning and/or testing function.

One further object of this invention is to provide a granular material cleaning apparatus having a screen agitator assembly with reciprocating, elongated brush members which are operable to brush spaced, respective screen members having the granular material thereon to separate foreign material therefrom.

Still another object of this invention is to provide a granular material cleaning apparatus providing for the movement of granular material through a material inlet control assembly so as to move the granular material in a regulated manner into a material flow channel assembly which provides for reversing of direction of the flow of the granular material therewithin so as to achieve an efficient and effective processing and structure for removing debris and foreign material from the granular material requiring the minimum amount of space and power requirements.

One other object of this invention is to provide a new and novel process utilizing a granular material cleaning apparatus of this invention operable to (1) receive the granular material at an upper inlet housing portion; (2) control the movement of the granular material therethrough through the use of a material inlet control assembly; (3) move the granular material transversely through a material flow channel assembly in order to utilize various sizes of separator screen members; (4) utilize a fluid flow assembly adaptable to use the surrounding atmospheric air and a blower structure to create an air flow to pick up and convey debris and foreign material from the granular material flowing therethrough; (5) utilize a screen agitator assembly operable to achieve periodic agitation of the screen members having the granular material thereon; and (6) utilize a discharge housing assembly so as to receive clean granular material and move the separated, removed foreign material away from the main container housing assembly.

One further object of this invention is to provide a granular material cleaner apparatus which can be attached to new or existing storage or grain handling structures; which is compact and sturdy in construction; which is efficient and effective in operation utilizing mainly the force of gravity to achieve the separating function thereof; which is substantially maintenance free; and which is economical in operation.

Various other objects, advantages, and features of the invention will become apparent to those skilled in the art from the following discussion, taken in conjunction with the accompanying drawings in which:

DETAILED DESCRIPTION OF THE INVENTION

Figure 1:
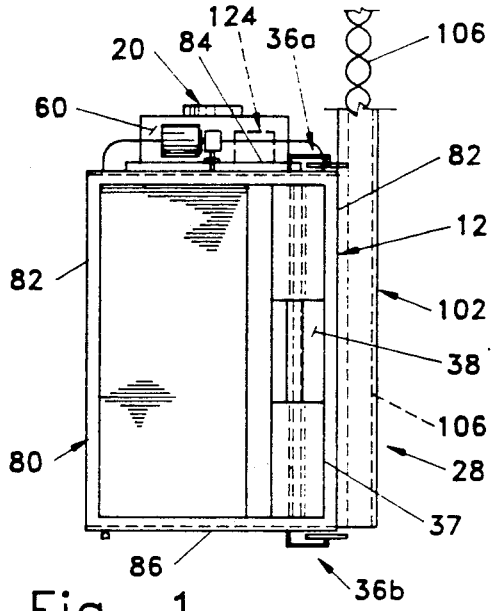
FIG. 1 is a top plan view of the granular material cleaning apparatus of this invention.
Figure 2:
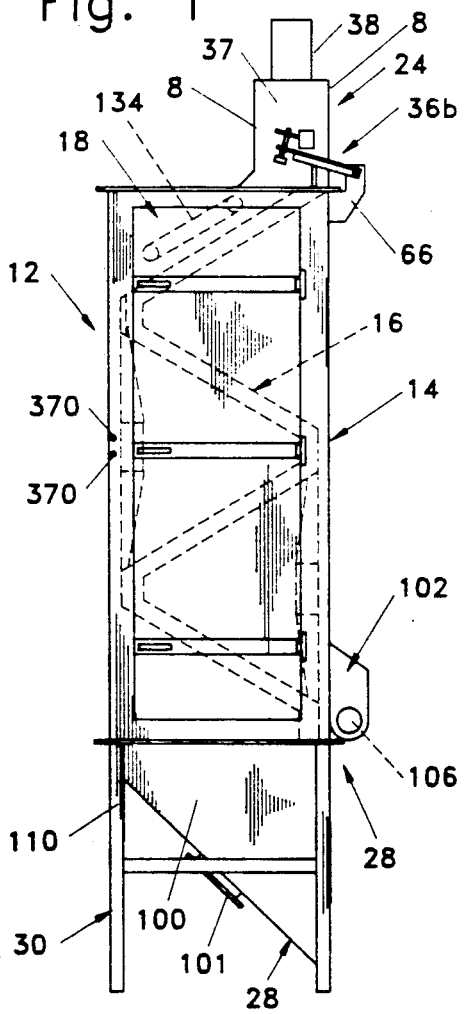
FIG. 2 is a side elevational view of the invention.

Referring in detail now to the drawings wherein similar parts of the invention are identified by like reference numerals, there is seen the granular material cleaning apparatus of this invention, indicated generally as 12, which is operable to receive a granular material therein at an upper inlet portion and process same as it falls downwardly under the force of gravity through various screen members and utilizing an air flow to remove debris and foreign material from the granular material supplied thereto before the same exits at a lower discharge end thereof. The granular material cleaning apparatus 12 can be constructed of various sizes so as to be portable for small testing and cleaning operations or of a large size to use for cleaning granular material before shipping to foreign countries on large vessels.

The granular material cleaning apparatus 12 includes (1) an upright container housing assembly 14; (2) a material flow channel assembly 16 mounted within the container housing assembly 14; (3) a material inlet control assembly 18 mounted at an upper inlet portion of the container housing assembly 14 to aid in the flow of granular material therethrough; (4) a fluid flow assembly 20 mounted on and/or in communication with the container housing assembly 14 operable to supply fluid or air flow therein to aid in the material cleansing process; and (5) a screen agitator assembly 22 mounted within the container housing assembly 14 and operably connected and/or slidably engaged to portions of the material flow channel assembly 16 to further aid in the material cleansing process. The container housing assembly 14 includes a pivotally connected inlet housing assembly 24 (i.e., a hopper) to initially receive the granular material; an intermediate or central separator housing assembly 26 which encloses the material flow channel assembly 16; a discharge housing assembly 28 to receive and discharge cleansed granular material and the foreign matter and debris into separate channels; and a main support assembly 30 adapted to receive and support the aforementioned housing assemblies 24, 26 and 28.

Figure 5:
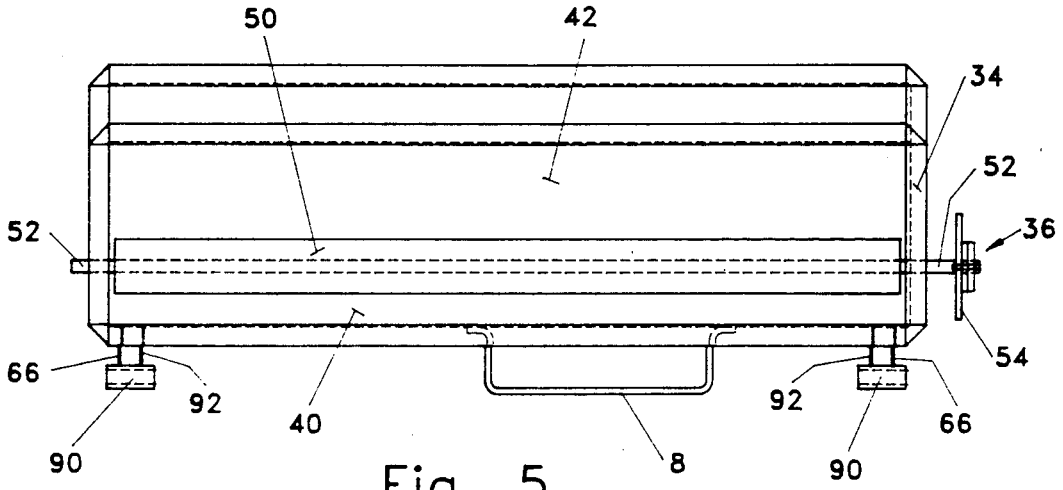
FIG. 5 is a top elevational view of the inlet housing assembly or hopper.
Figure 6:
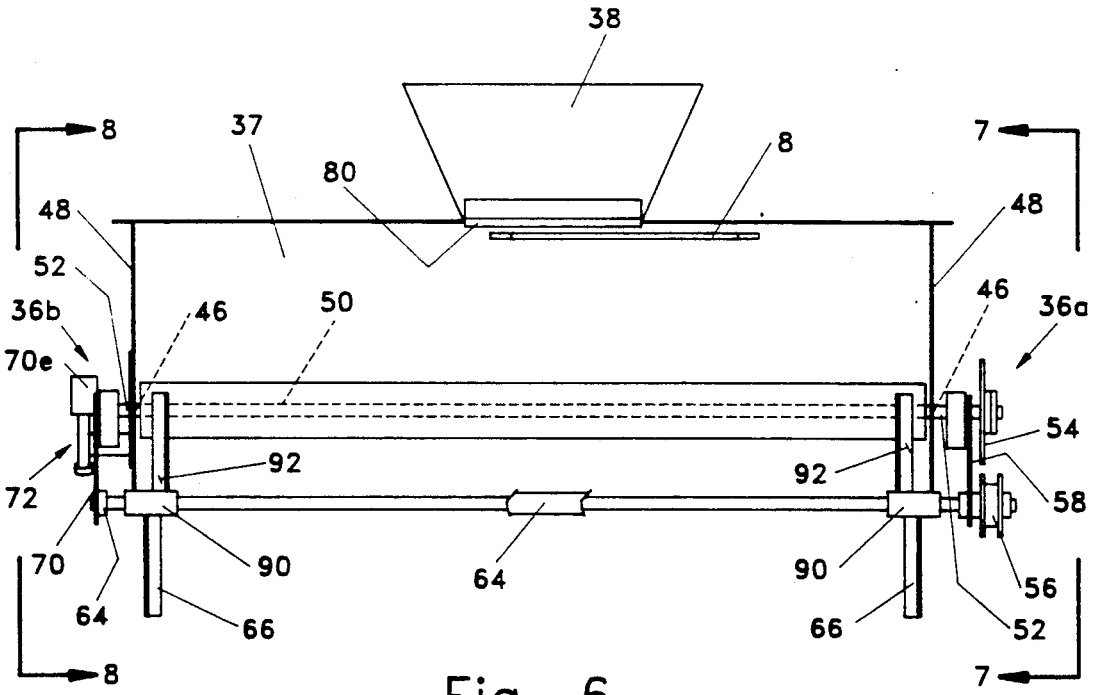
FIG. 6 is a front elevational view of the hopper.
Figure 7:
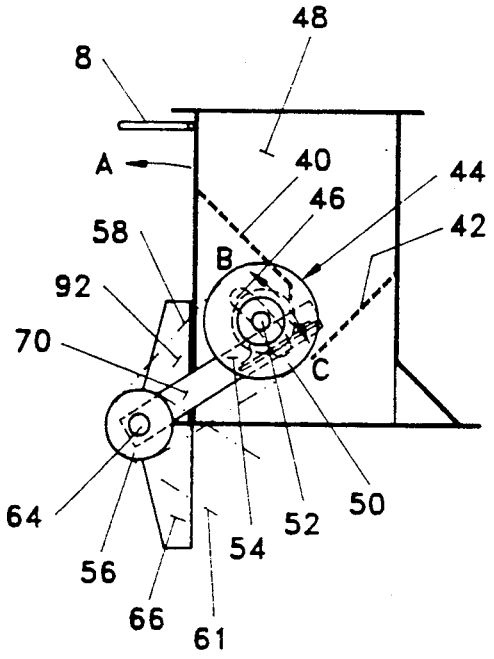
FIG. 7 is an elevational view of the hopper taken in direction of the arrows and along the plane of line 7—7 in FIG. 6.
Figure 8:
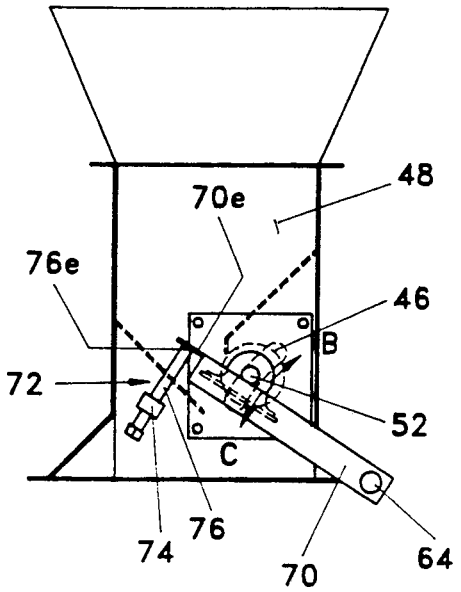
FIG. 8 is an elevational view of the hopper taken in direction of the arrows and along the plane of line 8—8 in FIG. 6.

As best shown in FIGS. 1-8, the inlet housing assembly 24 is a hopper member 34 pivotally connected to the container housing assembly 14 by linkage assembly, generally illustrated as 36B. Linkage assembly 36A also pivotally connects the hopper member 34 to the container housing assembly. The hopper member 34 is provided with a main or base hollow rectangular shaped body 37 having at least one handle member 8. Communicating with the base body 37 is an auxiliary hopper 38 mounted on top of the base body 37. As best shown in FIGS. 5, 6 and 7, the base body 37 is provided with an upper downwardly sloping rectangular shaped flange member 40 and a lower downwardly sloping rectangular shaped flange member 42, each terminating in a spaced relationship with respect to each other to define an opening 44 wherethrough granular material to be cleaned passes after passing through auxiliary hopper 38. Rotatably disposed in a pair of opposed longitudinal slots 46—46 in a pair of opposed end walls 48—48 of the base body is a metering roll 50 which is mounted to a shaft 52. As shown, the ends of shaft 52 slidably pass through and lodge in slots 46—46. Secured at one end of the shaft 52 is a driven sheave (or sprocket) 54 which receives rotary motion or power from a drive sheave (or sprocket) 56. An endless belt (or chain) 58 entrains sheaves 54 and 56. Sheave 56 is rotatably coupled to a drive motor 60 via endless belt or chain 61. Motor 60 is either mounted on the housing assembly 12 (see FIG. 3) or on a trailer 62 (see FIG. 22). Sheave 56 is rotatably mounted on an axle (or pipe) 64 which is secured to the housing assembly 14 via lower brackets 66—66 secured to sheaves 90—90. Sheaves 90—90 are also mounted to upper brackets 92—92 that connect to the hopper member 34 and/or the base body 37. The position of metering roll 50 over the opening 44 may be adjusted by linkage assembly 36B. Linkage assembly 36B, as best illustrated in FIGS. 6 and 8, comprises a lever 70 pivotally mounted to shaft 64, and an adjustment bolt assembly 72 affixed to one of the end walls 48. The bolt assembly 72 more particularly has a bolt support bracket 74 affixed to one of the end walls 48 and a bolt member 76 threadably engaged to the bracket 74 and having an end 76*e* in contact with an end 70*e* of the lever 70. As best shown in FIG. 8, an end of shaft 52 rests on lever 70. To raise the shaft 52 in direction of arrow B in FIGS. 7 and 8, bolt member 76 is rotated into bracket 74 such as to move the end 70*e* of the lever 70 also in direction of arrow B. Similarly to lower the shaft 52 in direction of arrow C in FIGS. 7 and 8, bolt member 76 is rotated out of bracket 74 such as to move the end 70*e* of the lever 70 also in direction of arrow C. As shaft 52 moves, the associated metering roll 50 also moves. When the shaft 52 moves in direction of arrow B in FIGS. 7 and 8, the metering roll 50 moves such that the opening 44 becomes larger which allows more granular material to pass through opening 44 and into the inlet control assembly 18. Likewise, when the shaft 52 moves in direction of arrow C in FIGS. 7 and 8, the metering roll 50 moves such that the opening 44 becomes smaller, allowing less granular material to pass through the opening 44 and into the inlet control assembly 18. Metering roll 50 functions as an adjustable power driven roller 50 for the hopper 34 to control the flow of granular material therethrough while simultaneously assisting in spreading the granular material throughout the hopper member 34 and the base body 37. The hopper member 34 and/or the base body 37 is not provided with a spread auger since the height between the flanged member 42 and a bottom opening 80 of the auxiliary hopper 38 is such that the rotating metering roll 50 simultaneously functions as a spreading auger. The entire inlet housing assembly 24 including the hopper member 34 and the base body 37 may be pivoted in direction of the arrow A in FIG. 7 by grasping the handle 8 and pulling in direction of the arrow A, to pivot the housing assembly 24 about the axis of axle or pipe 64. The inlet housing assembly 24 can pivot up to 180 degrees to essentially lessen the height of the inlet housing assembly 24 since the height of the housing assembly 24 including the auxiliary hopper 38 is longer or greater than the width of the housing assembly 24 including the hopper member 34 and/or the base body 37.

Figure 27:
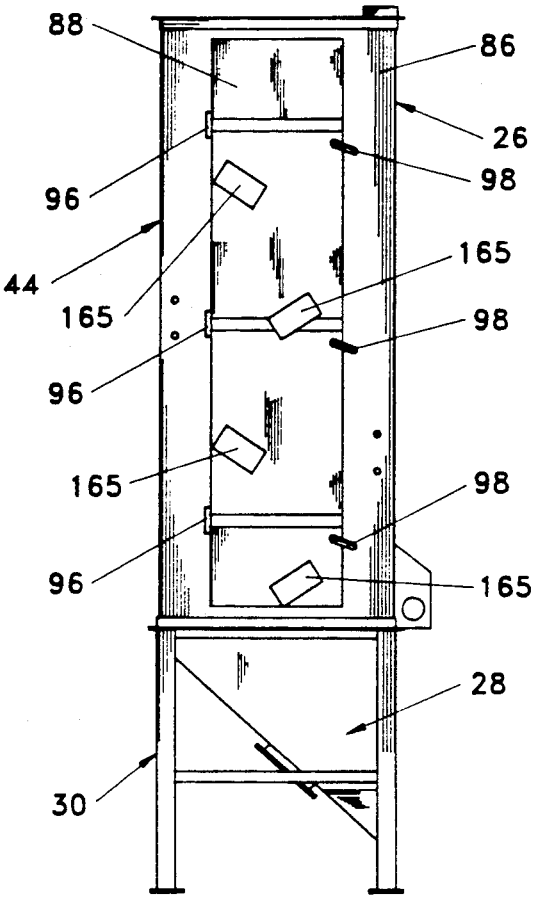
FIG. 27 is a back elevational view of the invention with the upper inlet housing assembly removed.

The separator housing assembly 26 includes an elongated upright main housing member 80 (see FIG. 1). The housing member 80 is of generally rectangular box shape having parallel side walls 82—82 interconnected at one edge by a front wall 84 and at opposite edges with a back wall 86. The back wall 86 is provided with an entrance door 88 as best shown in FIG. 27. The entrance door 88 is pivotally connected by hinge members 96 on one edge thereof and releasably connected as by lock handles 98 on the opposite edge thereof in a sealed manner. The access door 88 is operable to be opened to reveal the interior of the entire upright separator housing assembly 26 for repair and maintenance functions.

The discharge housing assembly 28 is provided with an exterior optional cleansed material discharge hopper 100 and a debris discharge auger assembly 102. The optional material discharge hopper 100 extends across one edge of the bottom surface of the separator housing 26. The material discharge hopper 100 extends the entire width thereof and directs the cleansed granular material downwardly to a rectangular outlet opening 101.

The exterior auger assembly 102 includes an exterior auger housing 104 wherein an auger 106 rotatably lodges to receive heavy contaminants from within the housing assembly 14, more specifically from the material flow channel assembly 16, and to carry heavy contaminants away from the container housing assembly 14, all as will be explained in greater detail below.

The main support assembly 30 in one embodiment of the invention consists of spaced upright channel beams or corner posts 110 which are secured to the main housing member 80 to provide the necessary rigidity and structure to the container housing assembly 14 of this invention. In another embodiment of the invention, the main support assembly 30 is the trailer 62 depicted in FIG. 22, without the corner posts 110.

Figure 9A:
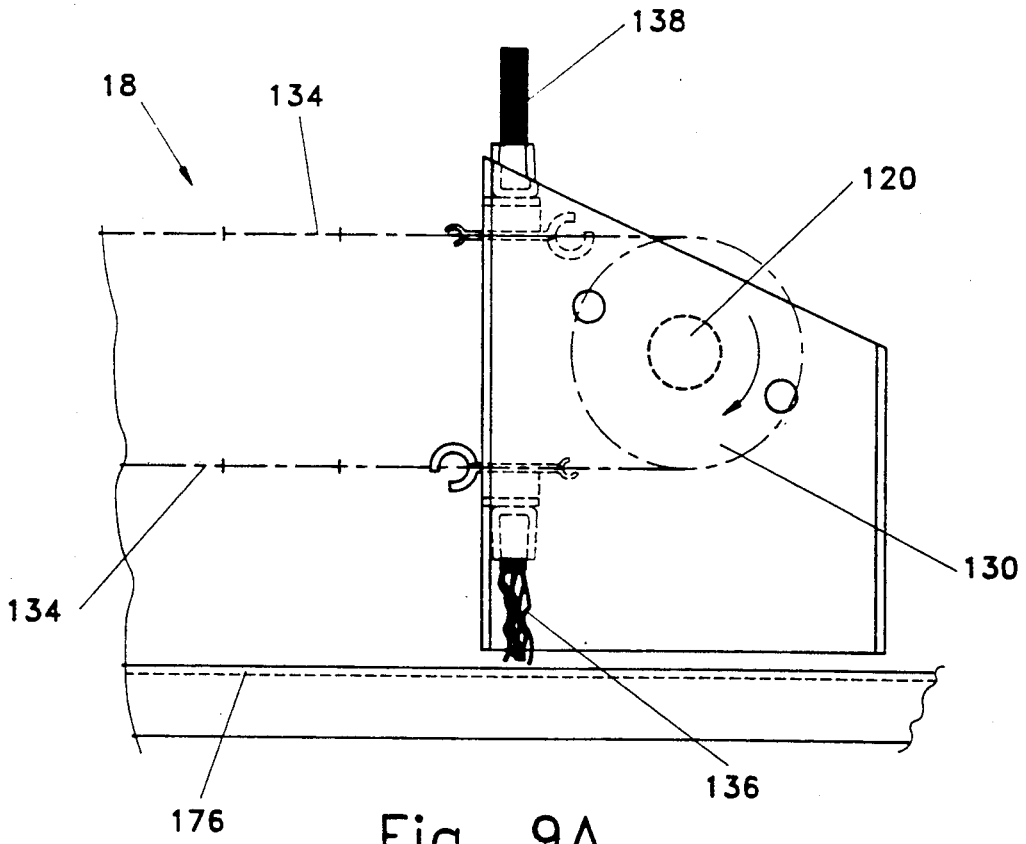
FIG. 9A is a partial segmented view of the inlet control assembly.
Figure 9B:
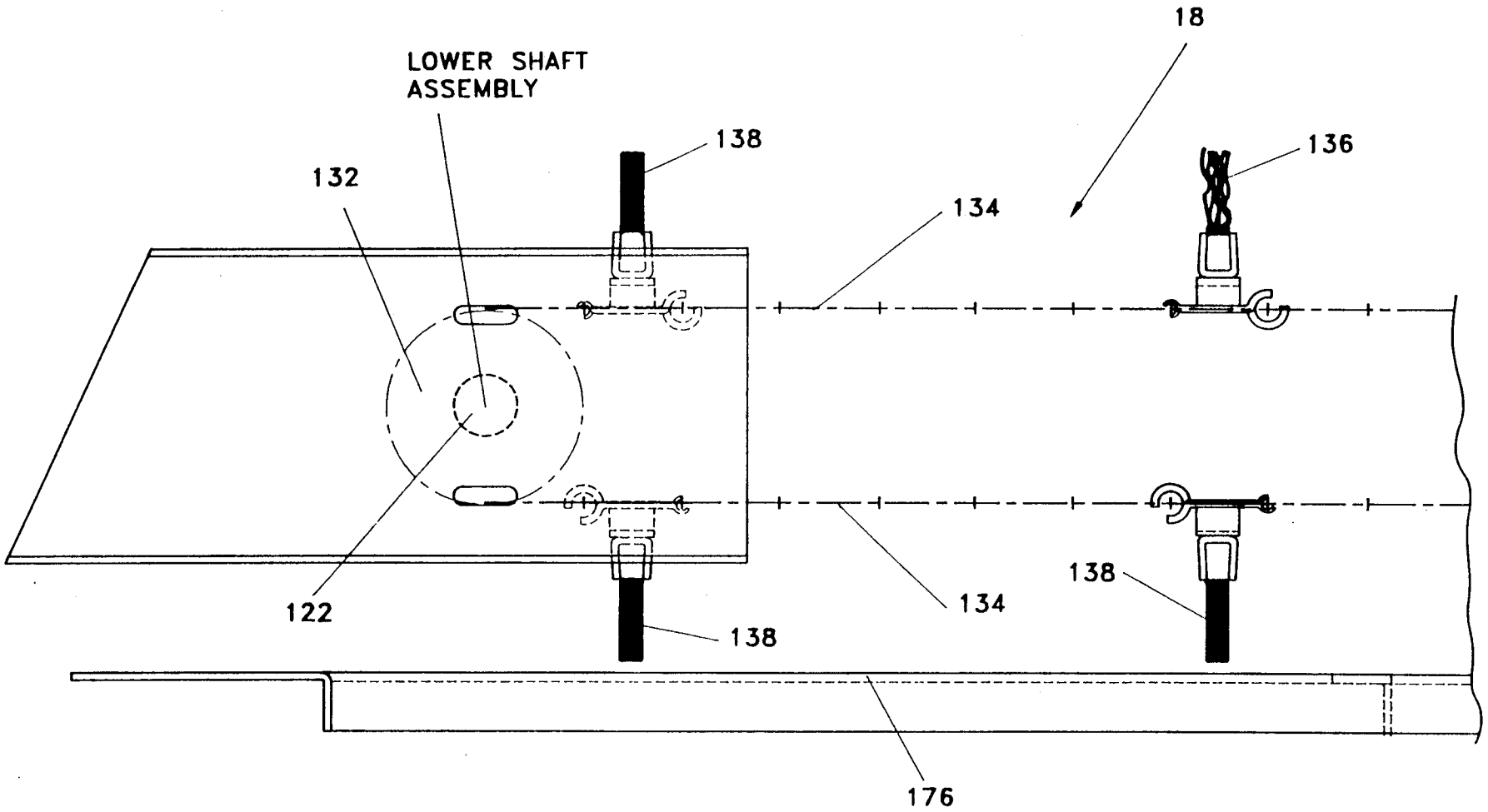
FIG. 9B is a partial segmented view and a continuation of the view in FIG. 9A of the inlet control assembly.

As best shown in FIGS. 9A and 9B the material inlet control assembly 18 includes an upper shaft 120 and a lower shaft 122 both rotatably connected to and between walls 84 and 86. A drive power means 124 (such as motor 60) has an endless belt (or chain) 125 that is engaged to an end of shaft 120 or shaft 122 to rotate the same (see FIG. 13). Any means may be provided to turn and power rotatably either the upper shaft 120 and/or the lower shaft 122. As indicated, the drive power means 124 may be the motor 60 itself, or a separate drive power means which turns the shaft 120 or shaft 122 independent of the motor 60, which as previously indicated, turns the metering roll 50. Associated with the upper shaft 120 and the lower shaft 122 is upper wheel 130 and lower wheel 132, respectively. Entrained around the upper and lower wheels 130 and 132 is a belt (or chain) 34. Connected to the belt or chain 134 at any desired, spaced interval are brushes 136 and paddles (or end drag members) 138. As the belt or chain 134 goes around and around, the brushes 136 and paddles 138 pass in close proximity to a first screen or grid member 176 which initially receives the granular material thereon on first entering the material flow channel assembly 16 from the inlet housing assembly 24 (i.e., hopper 34).

Figure 10:
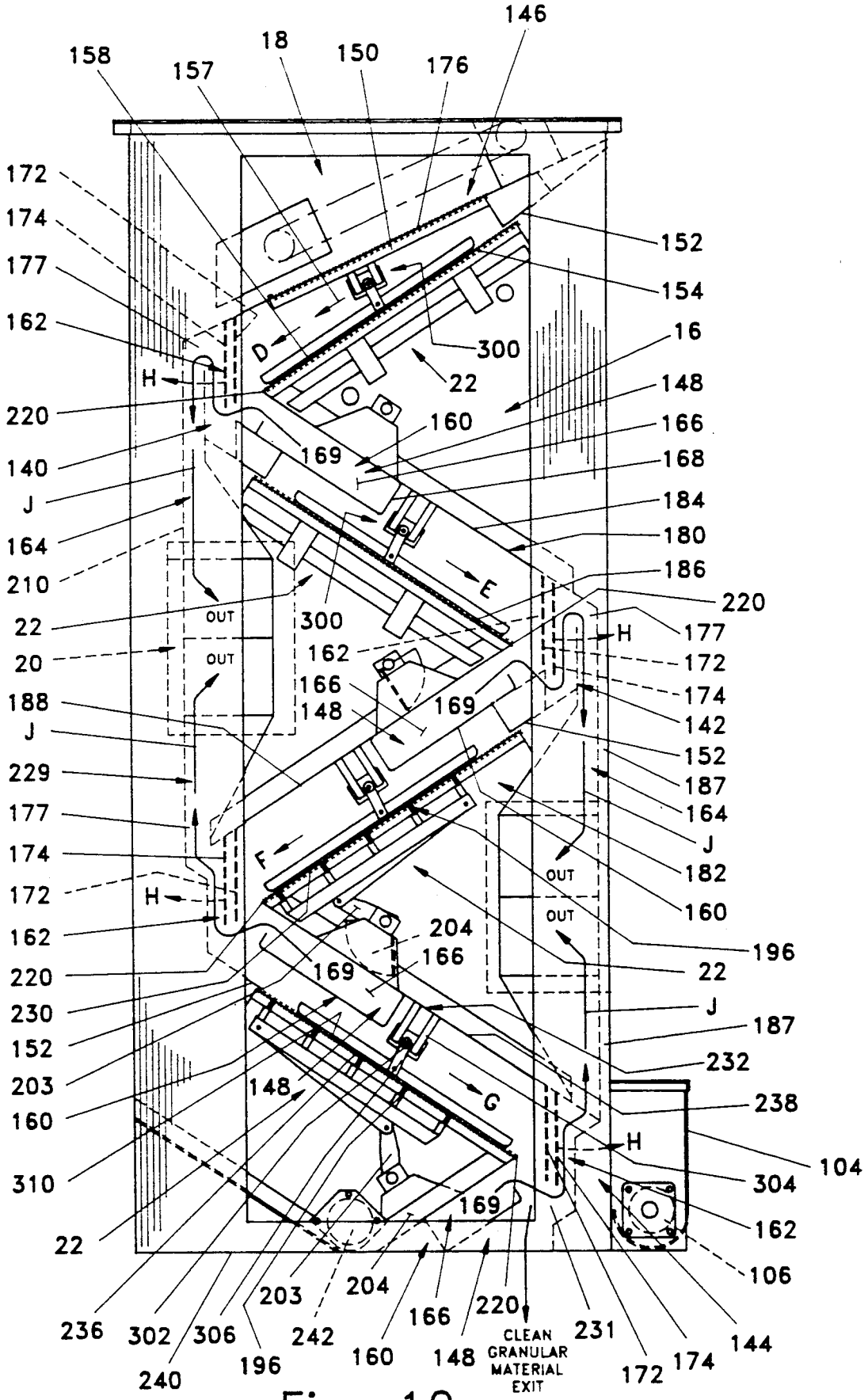
FIG. 10 is an enlarged elevational view of the separator housing assembly having portions thereof broken away for clarity to illustrate the internal workings thereof.
Figure 11:
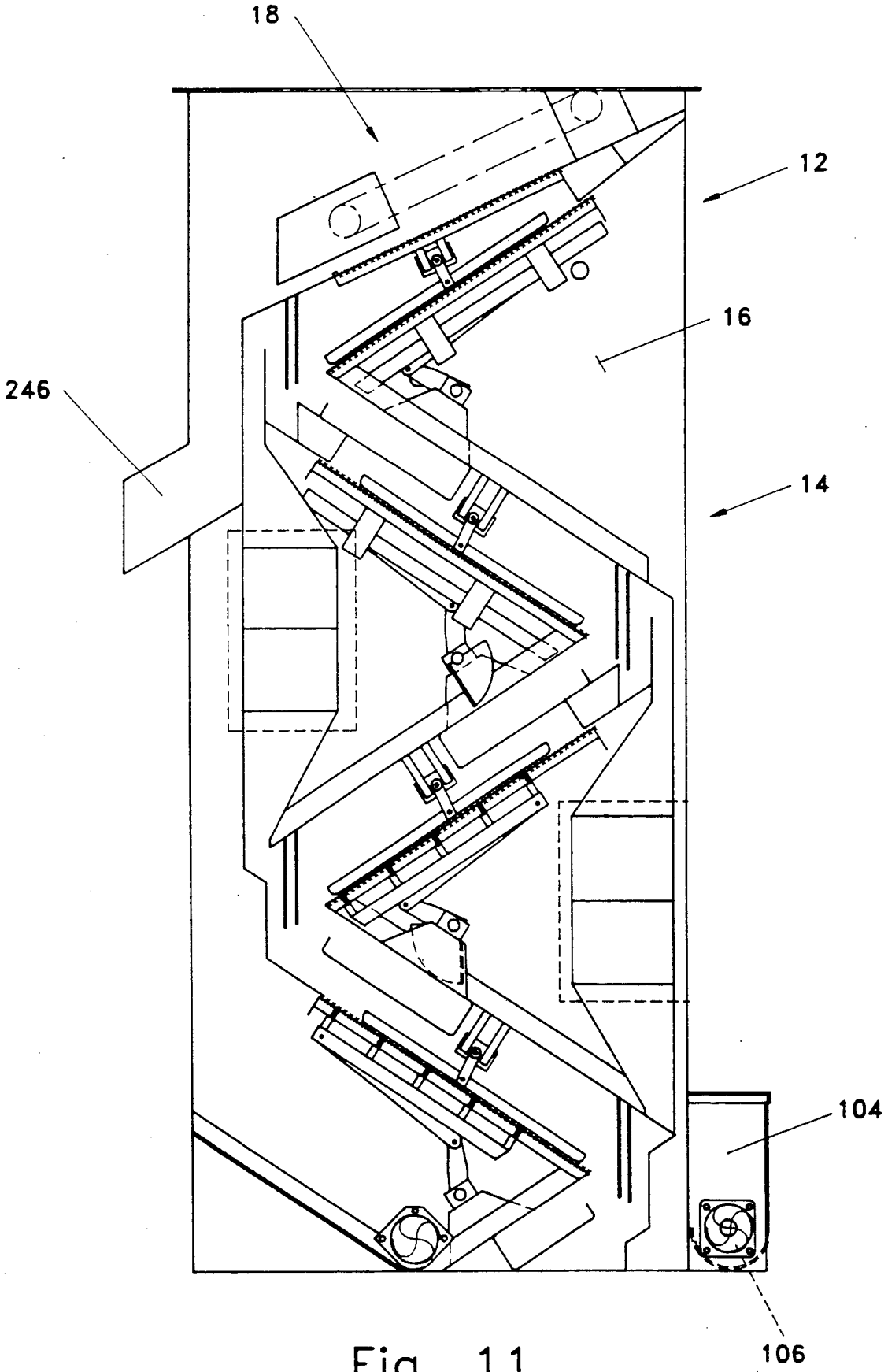
FIG. 11 is an enlarged elevational view of the separator housing assembly depicted in FIG. 10.
Figure 12:
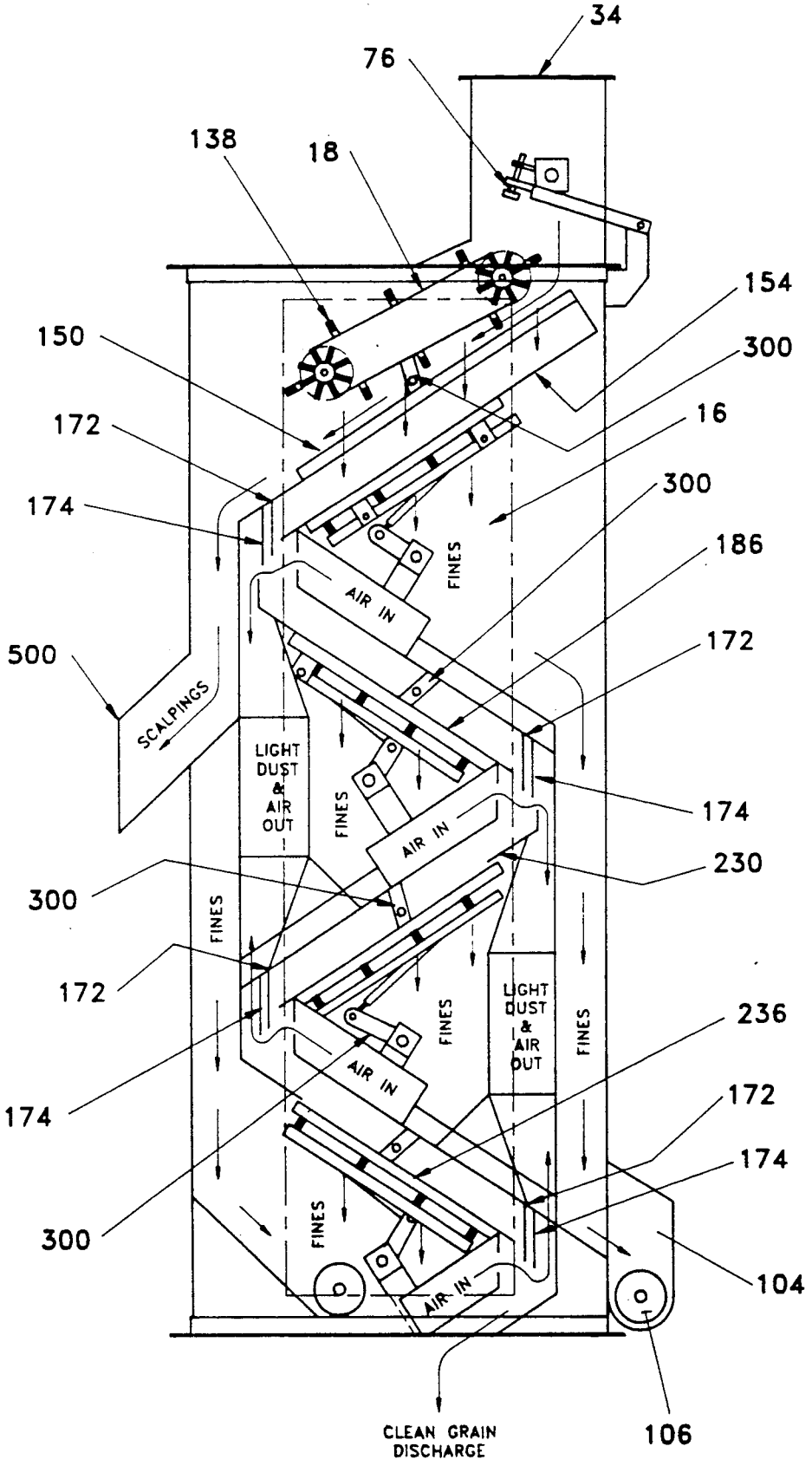
FIG. 12 is yet another enlarged elevational view of the separator housing assembly depicted in FIGS. 10 and 11.

As best shown in FIGS. 10, 11 and 12, the separator container housing assembly is shown with portions broken away to illustrate the material flow channel assembly 16 which includes (1) a first inlet support and filter assembly 140; (2) an intermediate support and filter assembly 142; and (3) a discharge support and filter assembly 144.

The first inlet support and filter assembly 140 includes (1) a material direction and control assembly 146; and (2) a material and debris separator assembly 148. The material direction and control assembly 146 includes an initial or first screen assembly 150 supported on a support and containment frame 152, and a second screen member 154. The initial or first screen assembly 150 includes a first screen or grid member 176 which initially receives the granular material thereon on first entering the material flow channel assembly 16.

The support and containment frame 152 is provided with an outer periphery of channel iron and is connected to the adjacent portions of the separator housing assembly 26. The support and containment frame 152 operates to assure that all of the granular material received from above is directed and flows through the first screen member 176 and any large debris or foreign material is carried on the first screen member 176 laterally therefrom in an outer channel to be explained.

The second screen member 154 includes a second grid member 158 adapted to receive the granular material with its foreign particles therewith which has just passed through the first screen member 176. The remaining granular material with debris therein moves downwardly as shown by an arrow 159 into a second cleansing stage being the intermediate support and filter assembly 142.

Figure 13:
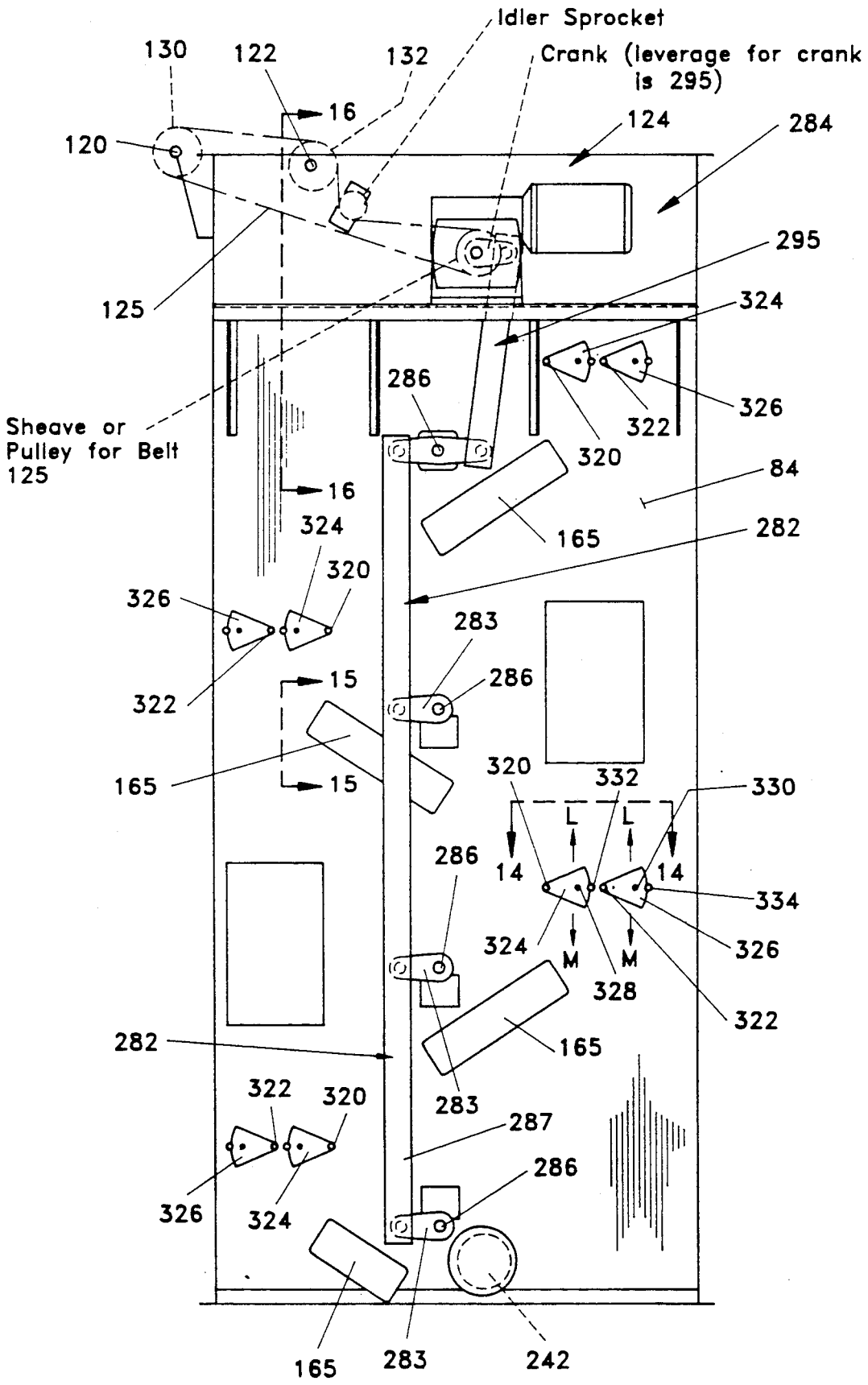
FIG. 13 is a side elevational view of the container housing assembly.

Each of the material and debris separator assemblies 148 includes (1) a fluid inlet assembly 160; (2) a fluid baffle assembly 162; and (3) a fluid discharge assembly 164. The fluid inlet assembly 160 includes a large inlet plenum or air chamber 168 having an air inlet opening 166 addressed to receive outside air through openings 165 in the door 88 or in the wall 84 as shown in FIGS. 13 and 27. The respective openings 165 register with the respective chambers 168. The inlet plenum 168 is operable to receive and transfer the inlet air under vacuum pressure for flow through a rectangular opening 169 so as to pick up debris and foreign material in a manner to be explained. The opening 169 is such that air passes into the fluid baffle assembly 162 at the merging point 220 of the grid member (e.g. grid member 158) and one of the top walls to be identified below.

The fluid baffle assembly 162 includes a grain door 172 transversely pivotally connected to walls 84 and 86 within the housing assembly 14. Grain door 172 can be pivoted towards the flow of granular material (such as in direction of arrows D, E, F and G) in FIGS. 10 and 11 and set to lessen the opening between the grain door 172 and the merging point 220. The fluid baffle assembly 162 also includes an air door 174 transversely pivotally connected to walls 84 and 86 within the housing assembly 14. Air door 174 can be pivoted in direction of arrow H in FIG. 10 to control the flow of air through fluid discharge openings 177 and into the fluid discharge assembly 164. As air passes through the granular material in close proximity to the merging point 220, it picks up and removes dust and other light contaminants therefrom and passes same through the opening 177 and into the fluid discharge assembly 164. Arrows J reflect the flow of air out of the respective plenum chambers 168 via opening 169 and through the opening 177 where the air contains dust. The pivotally connected grain door 172 is adapted to contact granular material and control the flow of same to come into contact with air passing through opening 169. The pivotally connected air door 174 is adapted to control the flow of air (and dust or other light contaminants) through opening 177 and into the fluid discharge assembly 164.

The fluid discharge assembly 164 includes a fluid outlet chamber or plenum 210 operable to direct air downwardly into the fluid flow assembly 20 as will be explained. It is noted that the fluid outlet plenum 210 has the fluid discharge opening 177 which is similar to the inlet opening 169 from the fluid inlet assembly 160 and both direct fluid flow, normally air, the entire width of the separator housing assembly 26 to remove the foreign particles from the granular material being cleansed by the structure and process of this invention.

The intermediate support and filter assembly 142 includes (1) a first stage intermediate assembly 180; (2) a material and debris separator assembly 148; and (3) a second stage intermediate assembly 182. The first stage intermediate assembly 180 includes (1) a first intermediate top wall member 184; (2) a support and containment frame 152; and (3) a first intermediate screen member 186.

The first intermediate top wall member 184 is substantially an inclined plate member which is adapted to receive the foreign material flowing downwardly thereon from the above second screen member 154 and direct the same outwardly for discharge down an upright outer channel 187 which communicates with the auger 106 such that the foreign material can be removed away.

The support and containment frame 152, as previously described, is adapted to receive therewithin the first intermediate screen member 186. The first intermediate screen member 186 is substantially identical to the second screen member 154 as previously described but having a grid portion of different size mesh material so as to maintain the granular material thereon and allow a portion of the foreign material therein to fall therethrough to the second stage intermediate assembly 182.

The intermediate material and debris separator assembly 148 includes (1) a first inlet assembly 160; (2) a fluid baffle assembly 162; and (3) a fluid discharge assembly 164, all being as previously described.

The second stage intermediate assembly 182 includes (1) a second intermediate top wall member 188; (2) a support and containment frame 152; and (3) a second intermediate screen member 230. The second intermediate top wall member 188 extends across a substantial portion of the width of the separator housing assembly 26 and is operable similar to the first intermediate top wall member 184 to receive the debris and foreign material which has fallen through the first intermediate screen member 186 and carry the same outwardly to an upright outer channel portion 229.

Again, the support and containment frame 152 is as previously described and is applicable to receive the second intermediate screen member 230 therein so as to receive and direct properly the granular material and the foreign material.

The second intermediate screen member 230 is substantially identical to that previously described for the screen members 154, 176, and 186 except having a grid or screen portion of a different size for reasons to become obvious. It is noted that the second intermediate screen member 230 operates to convey and direct the granular material in an inclined and downwardly manner a shown by arrows F and G into the discharge support and filter assembly 144.

The discharge support and filter assembly 144 includes (1) a material and debris separator assembly 148 to receive the material from the intermediate support and filter assembly 142; (2) a discharge material assembly 232; (3) a second discharge material and separator assembly 148; and (4) a discharge chute section 234. It is noted that the discharge support and filter assembly 144 includes two of the previously described material and debris separator assemblies 148, each having (1) a fluid inlet assembly 160; (2) a fluid baffle assembly 162; and (3) a fluid discharge assembly 164 to achieve the flow of air therethrough.

The discharge material assembly 232 includes (1) an upper discharge top wall member 238 to receive the debris and foreign material which has fallen through the previously described second intermediate screen member 230 and convey the same into upright outer channel 187; (2) a support and containment frame assembly 152; and (3) a discharge screen member 236. The discharge top wall member 238 is of a rectangular plate type inclined relative to the separator housing assembly 26 so as to receive and direct the foreign material outwardly to the upright outer channel 187 as indicated.

The support and containment frame 152 is as previously described and is operable to receive and support the discharge screen member 236 therein.

The discharge screen member 236 is of a grid type structure as previously described for the other screen members 154, 176, 186 and 230 with the grid size to be determined by the type of material being cleansed and in light of this being the last cleansing stage. The discharge chute section 234 is downwardly convergent in shape to direct the cleansed granular material downwardly and inwardly into a common discharge opening 240.

Rotatably disposed at the bottom of the container housing assembly 14 is an auger 242 which transfers out of the housing assembly 18 foreign material (i.e., heavy contaminants) that have passed through the discharge screen member 236. Heavy contaminants that were scalped off screen 176 by inlet control assembly 18 can either pass through a chute 246 (as depicted in FIG. 11) or be allowed to drop down into the bottom of the housing assembly 14 to be removed by the auger 242 (as depicted in FIG. 10).

Mounted in contact with each screen (i.e., 154, 186, 230 and 236) is a screen hold down assembly 300 and a screen agitator assembly 22. The screen agitator assembly 22 includes (1) a rocker arm assembly 280 (see FIG. 3); (2) a rocker linkage assembly 282 connected to the rocker arm assembly 280; and (3) a rocker drive motor 184 connected to and driving the rocker linkage assembly 282 and interconnected rocker arm assemblies 280.

As best shown in FIG. 13, the rocker linkage assembly 282 includes a plurality of pivot rocker arms 283, each connected to outer end of respective rocker shafts 286 which rotatably pass into the housing assembly 14 and are movable with movement of the rocker linkage 282. As further noted in FIG. 13, the rocker arms 283 are then connected to an elongated link shaft 287 which is driven in a reciprocating manner by the drive motor 284. The drive motor 284 may be the same drive motor member 124 [or a different drive member (not shown)] used to actuate and power the material inlet control assembly 18. This is possible as a reciprocating vertical movement of the link shaft 287 via a linkage 295 coupled to a gear reduction member of the drive motor 124 would operate to pivot the rocker arm assembly 280 and drive the endless belt or chain 125 of the assembly 18.

The screen agitator assembly 22 of this invention is a screen agitator assembly 190, as shown in FIGS. 13, 18–21 and 26, having a plurality of rocker brush assemblies 192 moveable through the use of a rocker brush linkage assembly 194.

Each of the rocker brush assemblies 192 are provided with parallel, elongated brush members 196 mounted in support frames 198 for reciprocal movement as indicated by an arrow 199. The brush members 196 achieve reciprocal movement and brushing against the underside of the respective screen members 134, 176, 186, 230 and 236.

The brush members 196 are adapted to be moved a substantial lateral distance such as 8 to 10 inches so as to achieve periodic brushing of the respective screen members so as to loosen up and separate the debris and foreign material to achieve proper operation of the cleansing process of this invention.

The rocker brush linkage assembly 194 includes a plurality of brush connector assemblies 201 including (1) a pivot arm 203 pivotally connected at one end to a support post 204; (2) a link arm 206 having one end pivotally connected to the pivot arm 203; and (3) another outer end of the link arms 206 is pivotally connected to the respective support frames 198 to transmit reciprocal movement thereto.

The pivot arms 203 may be pivoted by the previously described ratchet arms 183, link shaft 187, and the drive motor 184 as used on the rocker linkage assembly 282 of the screen agitator assembly 22.

Figure 26A:
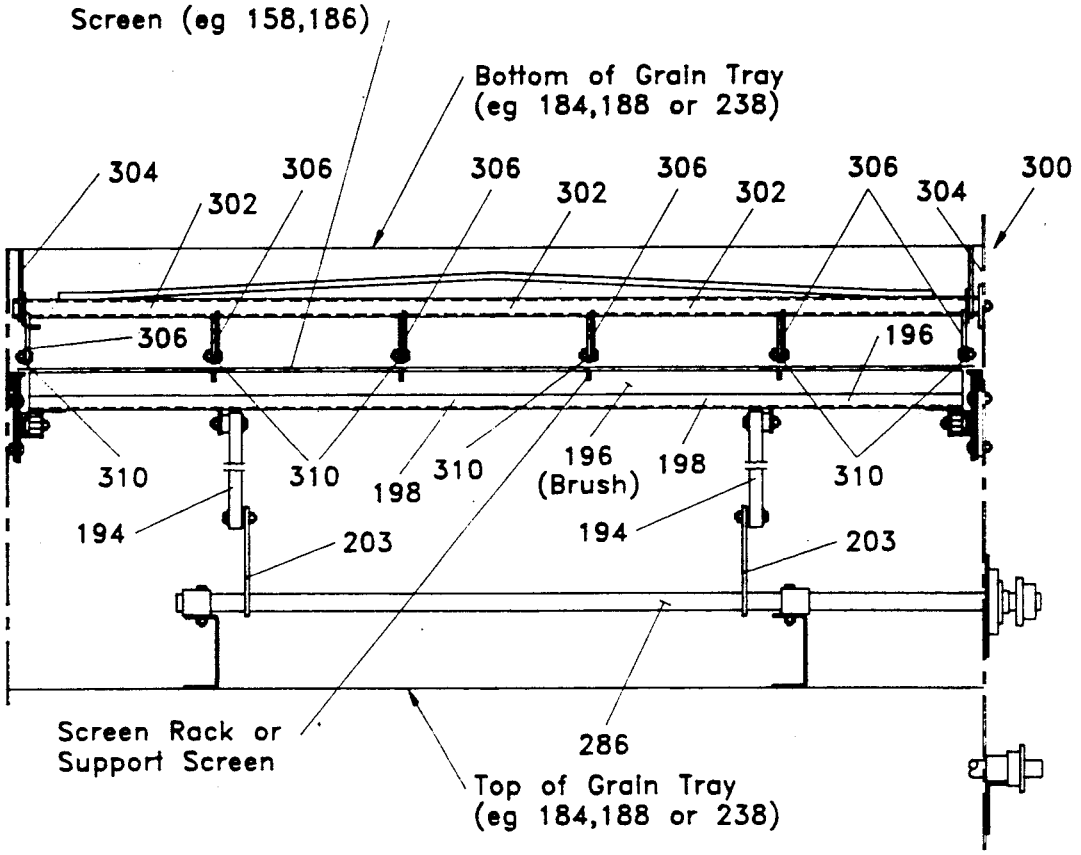
FIG. 26A is a front elevational view of the agitator screen assembly.
Figure 26B:
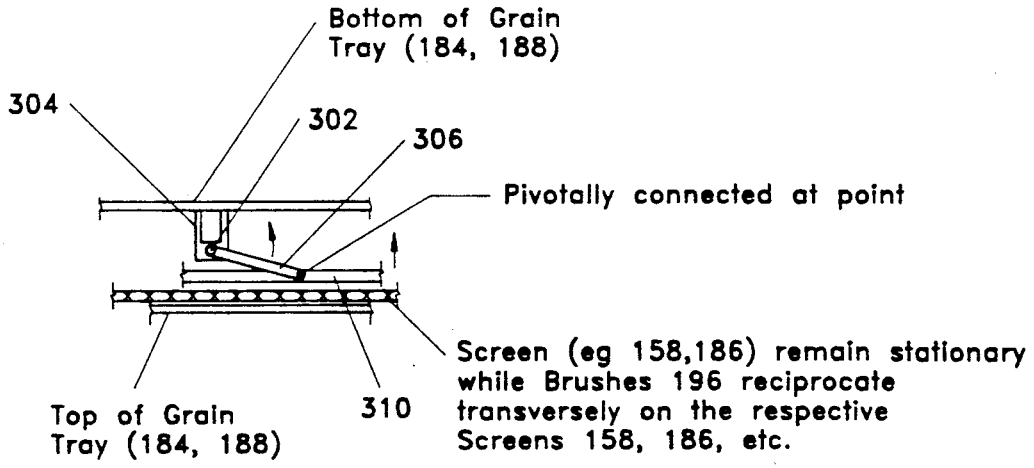
FIG. 26B is a partial side elevational view of a screen resting on top of a grain tray.

The screen assembly 300 comprises a shaft 302 rotatably supported by brackets 304 which mount underneath a top wall (e.g. 184, 188 or 238). Bound integrally to the shaft 302 is a plurality of shaft levers 306 to rotate therewith when shaft 302 is rotated, such as with a square neck tool or any other implement. Secured pivotally at the ends of at least two shaft levers 306—306 is a hold down rod 310 which releasably engages the respective screens to hold the same down. To remove or otherwise obtain access to a screen, the shaft 302 is rotated in a predetermined direction (such as counterclockwise) and the levers 306 rotate the same direction causing the ends of levers 306 to pivotally move the hold down rod 310 in the same direction. As the ends of levers 306 rise away from the screen, the rods 310 also rise while simultaneously pivoting at the end of the respective lever 306, as best shown in FIG. 26B.

Figure 14:
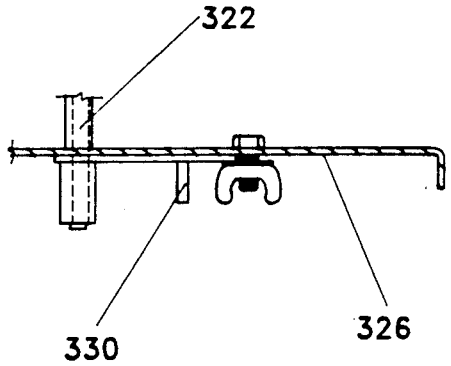
FIG. 14 is a partial sectional view taken in direction of the arrows and along the plane of line 14—14 in FIG. 13.
Figure 16:
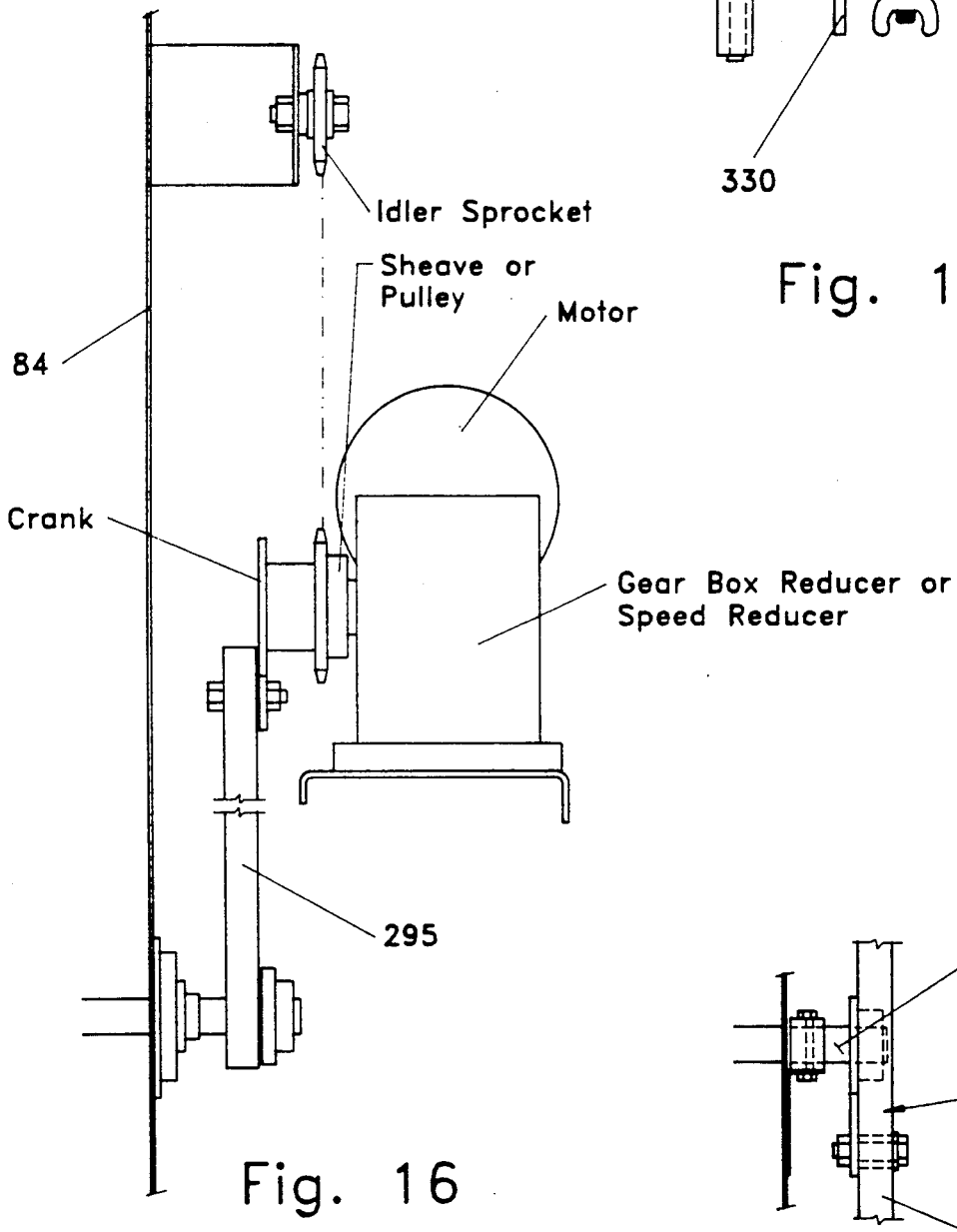
FIG. 16 is a partial sectional view taken in direction of the arrows and along the plane of line 16—16 in FIG. 13.
Figure 15:
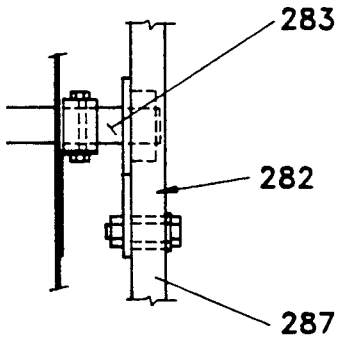
FIG. 15 is a partial sectional view taken in direction of the arrows and along the plane of line 15—15 in FIG. 13.

The grain doors 172 and the air doors 174 are respectively mounted on shafts 320 and 322 respectively which extend rotatably (or expand rotatably) from wall 84 to wall 86. The doors 172 and 174 essentially extend from wall 84 to wall 86 to generally traverse the entire width of the container assembly 14. The doors 172 and 174 are generally rectangular plate members that are bound on one longitudinal edge to the shafts 320 and 322 respectively. As best shown in FIGS. 13 and 14, shafts 320 and 322 have levers 324 and 326 mounted respectively at an end thereof. Levers 324 and 326 have lugs 328 and 330 to assist in moving the levers 324 and 326 in either the direction of arrows L or M in FIG. 13. Further in FIG. 13, movement of lever 326 in direction of arrow L (i.e., counterclockwise) causes the shaft 322 and the associated air door 174 to also move counterclockwise and in direction of opening 177 to restrict the flow rate of air therethrough. Movement of lever 326 in direction of arrow M (i.e., clockwise) causes the air door 174 to move away from opening 177 to allow a greater quantity of air to pass therethrough. Similarly, movement of lever 328 in direction of arrow L causes the shaft 320 and the associated grain door 172 to move away from the merging point 220 and the downwardly flow of grain to allow more grain to pass between the opening between the grain door 172 and the merging point 220. Movement of lever 328 in direction of arrow M causes the grain door 172 to move towards the merging point 220 and restrict the flow of grain between the opening between the grain door 172 and the merging point 220. Each lever 324 and 326 is provided with a locking mechanism (e.g. a wingsuit) 332 and 334 respectively bound to wall 84 to lock the levers 324 and 326 respectively in place after the desired setting for the grain door 172 and air door 174 has been obtained. Each grain door 172 can be individually set such that the right mixture of air (passing through opening 169 of air chamber 166) and grain passing over the merging point 220 can be obtained to remove the dust (and other light contaminants). Each grain door 172 can be set for the type of grain (e.g. oats, barley, wheat, etc.) to be cleaned. Obviously, certain grains or granular material would require a different setting for each grain door 172. The air doors 174 are optional and may be employed to control the flow of air and light contaminants (such as dust) through the openings 177 and into chambers 164 and 229. The use of air doors 174 would be based on the type of granular material to be cleaned and the amount of contamination.

The fluid flow assembly 20 has two embodiments. In the embodiment best shown in FIGS. 28 and 29, the fluid flow assembly 20 includes (1) a main fan blower housing 348; (2) a power fan assembly 350 connected to the fan blower housing 148; and (3) a fluid flow control assembly 352 to adjustably control the flow of fluid such as air therethrough (see FIG. 29).

Figure 28:
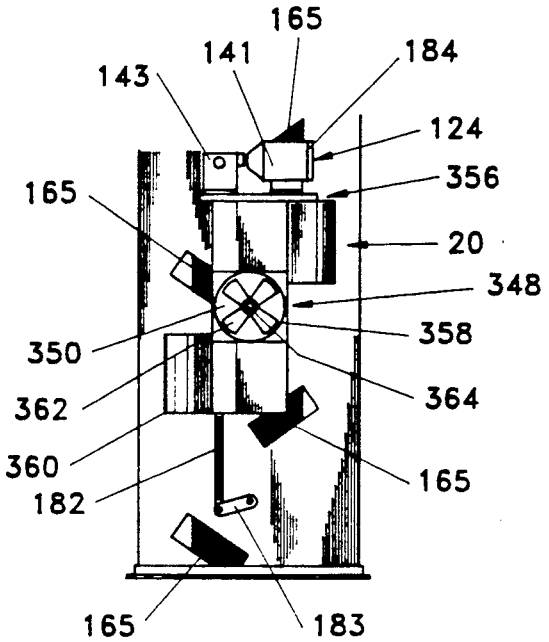
FIG. 28 is a partial elevational view of a side of the cleaning apparatus.
Figure 29:
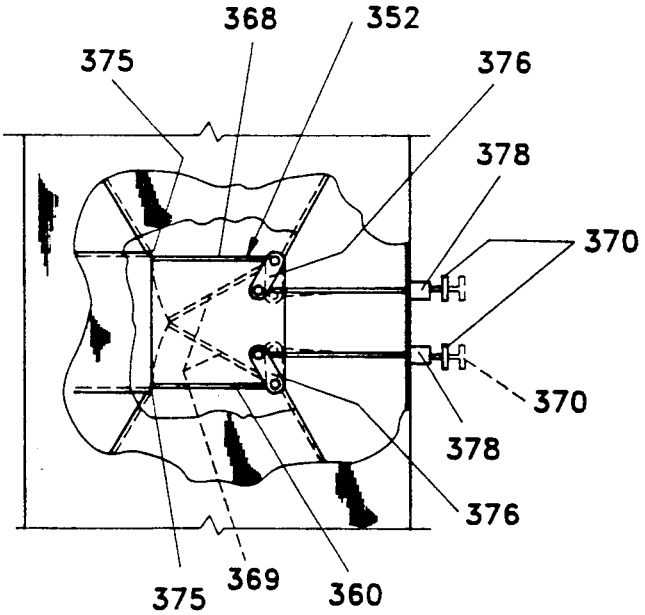
FIG. 29 is a fragmentary elevational view of a portion of the separator housing assembly having portions broken away to illustrate a control mechanism for a fluid flow assembly of the granular material cleaning apparatus.

As seen in FIG. 28, the fan blower housing assembly 348 includes an upper housing assembly 356 connected to a central fan housing 358 which, in turn, is connected to a lower housing assembly 360.

The upper housing assembly 356 operates to direct fluid flow (i.e., air plus light contaminants) from the fluid outlet plenums 164 and 229 on the left side of FIG. 10 and the fluid flow control assembly 352 on that side into the power fan assembly 350.

Similarly, the lower housing assembly 360 operates to direct fluid flow from the fluid inlet plenum 164 and 229 on the right side of FIG. 10 and the fluid flow control assembly 352 on that side into the power fan assembly 350.

The central fan housing 358 is connected to the upper and lower housing assemblies 356, 360 and directs fluid from both into the power fan assembly 350.

The power fan assembly 350 includes a fan blade member 362 which is operably connected to a variable speed electrical drive motor 364. The fan blade member 362 is operable to be rotated at a preselected speed depending on granular material being cleaned so as to move air flow through the air inlet openings 165 and outwardly through the upper and lower housings 356, 360 and discharge same through the fan housing 358. A filter member may be used to cleanse the air before being discharged back into the surrounding atmosphere.

The fluid flow control assembly 352 may include a pair of door assemblies 368, each controlling air flow in a respective one of the upper and lower housing assemblies 356, 360 into the central fan housing 358. As noted in FIG. 29, each door assembly 368 includes a pair of cooperating door members 369 which are moveable through respective link members 376 and control handles 370 to open and close respective fluid flow openings 375. It is obvious that this opening and closing of the door members 369 operate to control the amount and pressure of fluid flow therethrough. Each control handle 370 includes a lock thumb screw 378 to hold the respective door members 369 in an adjusted position.

Figure 3:
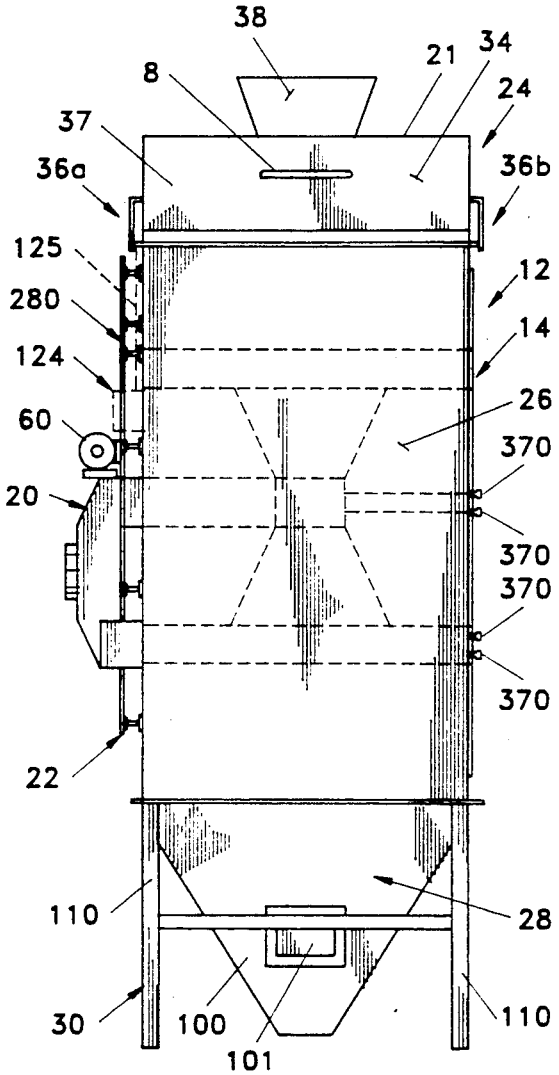
FIG. 3 is a front elevational view of the invention.
Figure 4:
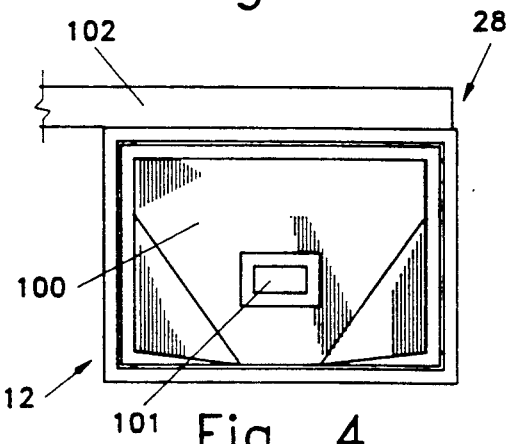
FIG. 4 is a bottom plan view of the invention.
Figure 17A:
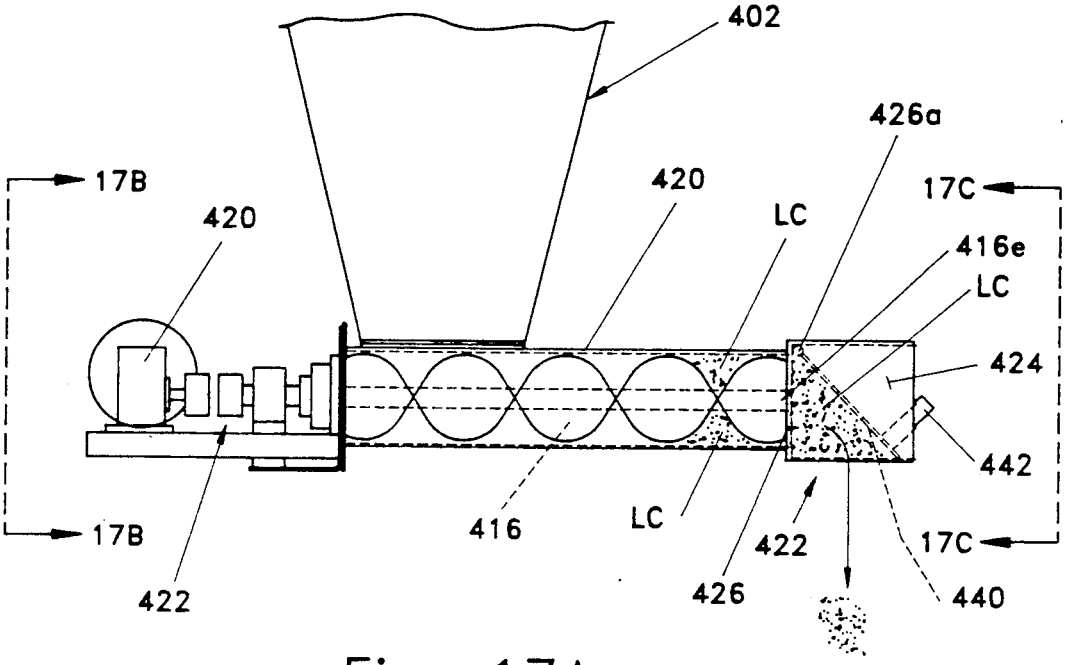
FIG. 17A is a partial side elevational view of the motor, and the lower half of the cyclone assembly including an auger and the airlock assembly.
Figure 17B:
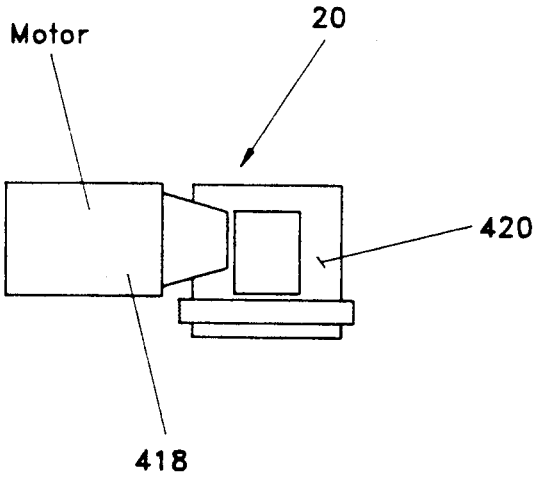
FIG. 17B is an end elevational view taken in direction of the arrows and along the plane of line **17*b*—17*b* in FIG. 17A**.
Figure 17C:
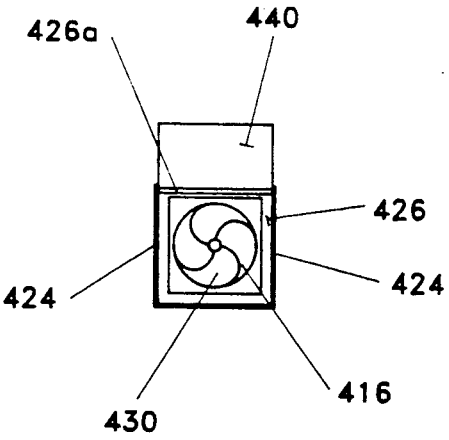
FIG. 17C is an end elevational view taken in direction of the arrows and along the plane of line 17C—17C in FIG. 17B.
Figure 18:
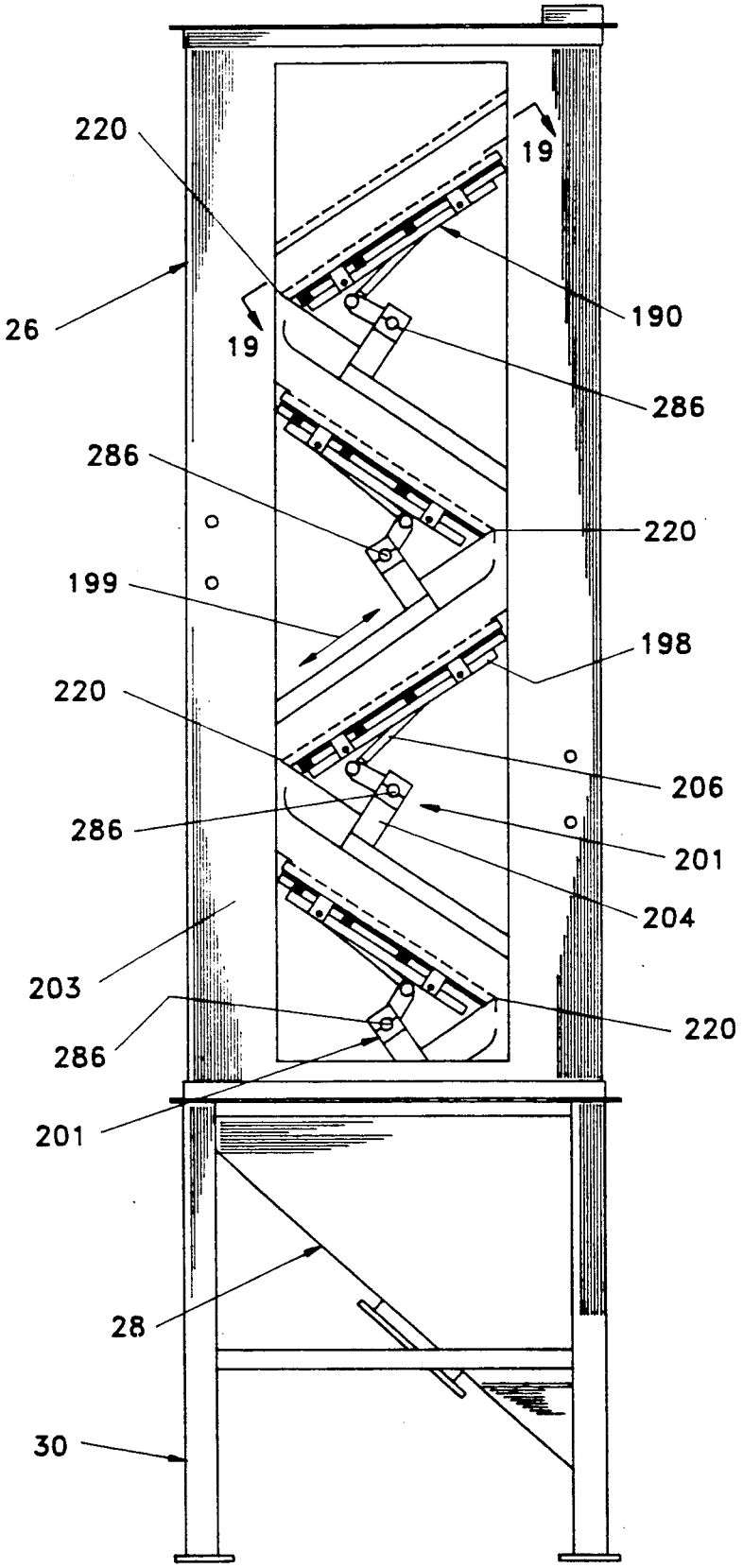
FIG. 18 is a side elevational view of the container housing assembly having a door member removed to illustrate the screen agitator assembly of the grain material cleaning apparatus of this invention.
Figure 19:
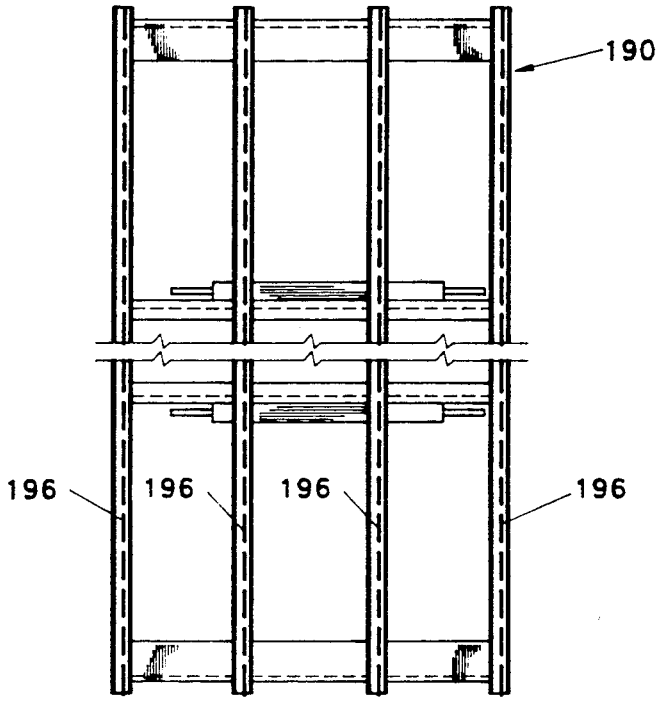
FIG. 19 is an enlarged view taken in direction of the arrows and along the plane of line 19—19 in FIG. 18.
Figure 20:
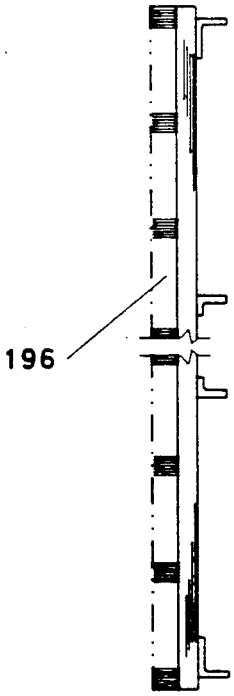
FIG. 20 is a side elevational view of the agitator screen assembly as shown in FIG. 19.
Figure 21:
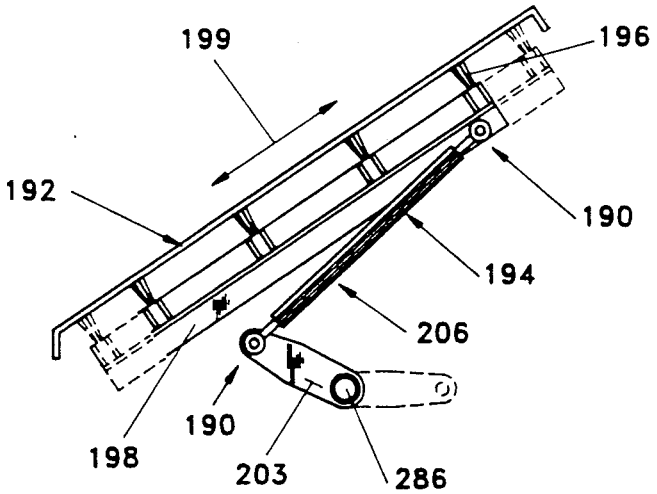
FIG. 21 is an end view of the agitator screen assembly.
Figure 22:
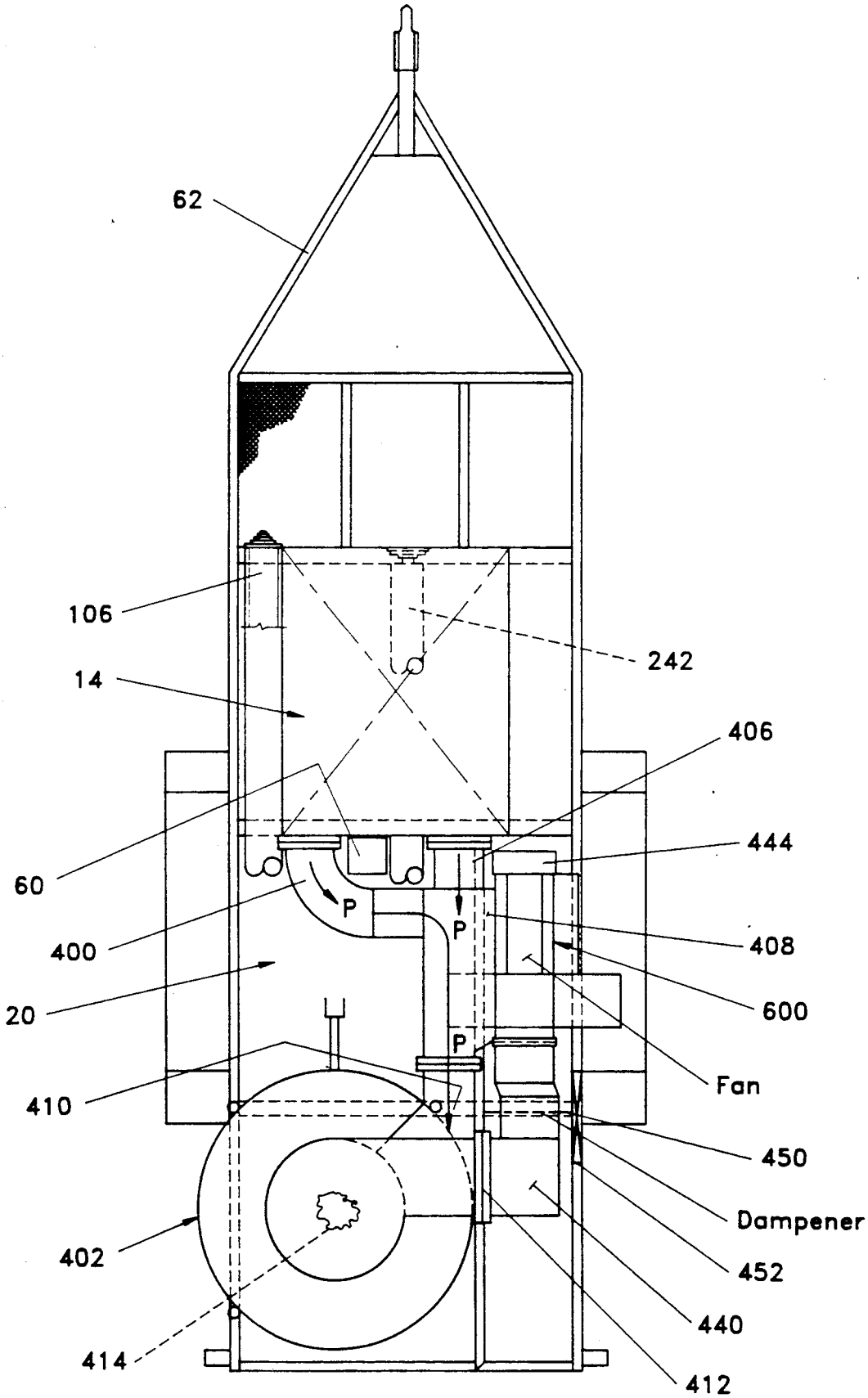
FIG. 22 is a top plan view of the apparatus of this invention mounted on a trailer.
Figure 23:
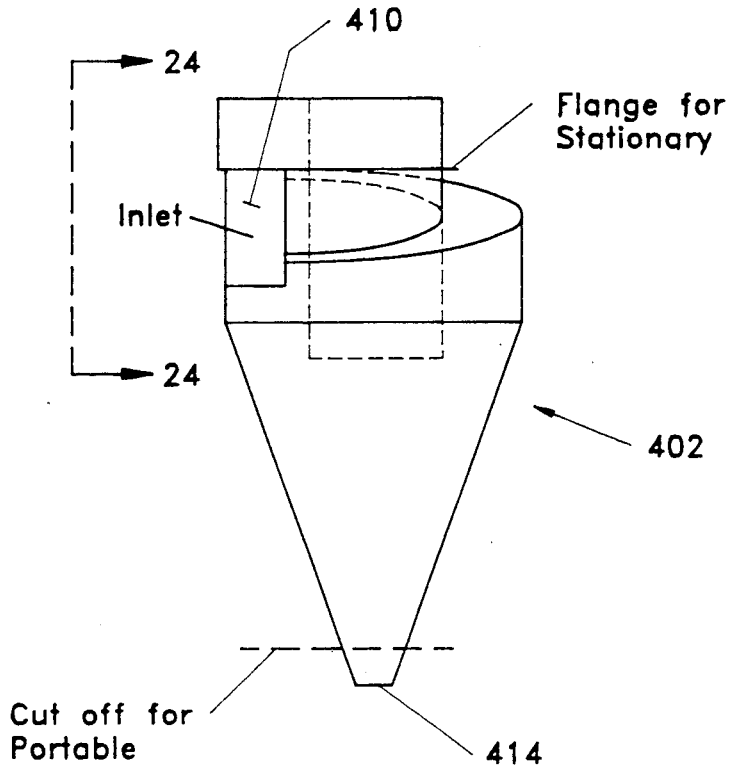
FIG. 23 is a side elevational view of the cyclon.
Figure 24:
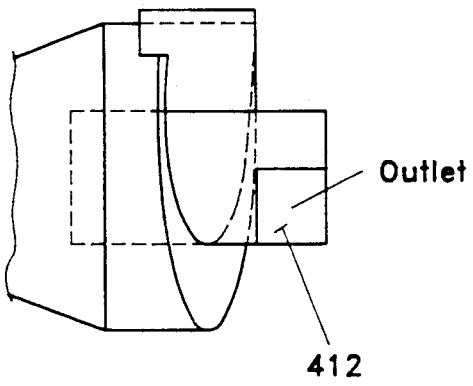
FIG. 24 is an elevational view taken in direction of the arrows and along the plane of line 24—24 in FIG. 23.
Figure 25:
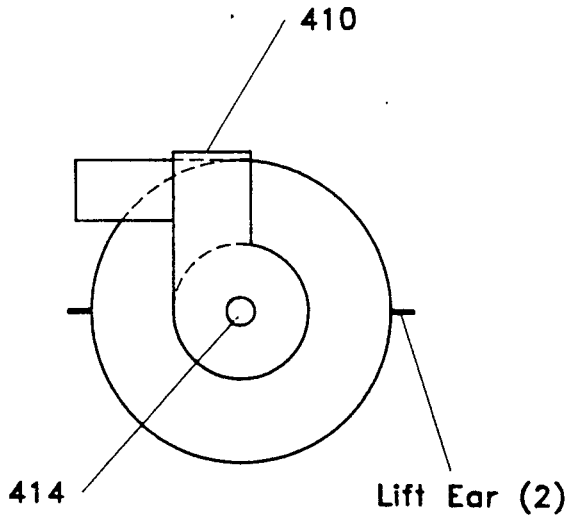
FIG. 25 is a top plan view of the cyclone in FIG. 23.

In a more preferred embodiment for the fluid flow assembly 20, as best illustrated in FIGS. 17A and 22, the fluid flow assembly 20 is mounted on the trailer 62 instead of on the container assembly 14 as shown in FIGS. 1 and 3. Fluid (i.e., air plus light contaminants) is sucked out of the chambers 164 and 229 by a fan (generally illustrated as 600) in direction of the arrow J in FIG. 10 and passes through conduits 400 and 406 and converges together in conduit 408 in the rear of the container assembly 14; and continues to pass through conduit 408 in direction of the arrows P—P in FIG. 22. From conduit 408, the fluid enters a conical shaped cyclone member, generally illustrated as 402, where light contaminants can be separated from the air through the tornado-like swirling of the fluid within the cyclone 402. As best shown in FIGS. 23-25, the 414 that communicates with an auger 416 (see FIG. 17A) which is powered by an auger motor 418. Auger 416 has an auger end 416e. Motor 418 drives all augers (i.e., augers 106, 242 and 416). Motor 418 is coupled to gears in a gear box 420 which in turn provides a jaw coupling 422 where all augers (i.e., augers 106, 242 and 416) receive rotary power. Auger 416 is rotatably disposed in an auger housing 420 (see FIG. 17A) which terminates in an air-lock box, generally illustrated as 422. Air-lock box 422 is necessary to hermetically seal the open end of auger housing 420 such that the fan 600 can take a suction within the container assembly 14 to pass and suck air through openings 165 into air chambers 166 and through openings 169. The air-lock box 422 comprises a pair of side walls 424—424 and a rear wall 426 with an opening 430 (see FIG. 17C) that communicates with the open end of the auger housing 420. The rear wall 420 has an upper edge 426*a* whereat a weighted plate 440 is hinged and pivoted thereto. The weighted plate 440 has a cylindrical lug 442 where around more weights (i.e., washers or the like) may be added to further weight the plate 440. As light contaminants LC (see FIG. 17A) are separated within the cyclon 402 they fall into the auger housing 420 where a rotating auger 46 moves the light contaminants LC to the auger end 416*e* where they accumulate. As they continue to sufficiently accumulate, they force the weight door 440 off and away from the opening 430 and fall out as illustrated in FIG. 17A. The system remains hermetically sealed because of sufficient accumulation of light contaminants LC at the auger end 416*e* within the auger housing 420.

Light contaminant-free air exits cyclone through outlet 412 and enters into conduit 440 which leads to fan 600 (which may be driven by any suitable motor 444). Conduit 440 may be provided with a suitable dampener 450, engageable on the outside at 452 to control the flow of clean air through conduit 440.

The granular material cleaning apparatus 12 can be constructed of various sizes from that utilized to cleanse a granular material as a test sample or as a unit of considerable size used to clean the granular material at a loading dock before shipping to foreign countries. The granular material cleaning apparatus 12 needs only a power supply such as an electrical source in order to operate (1) the fluid flow assembly 20 to move the air flow therethrough; (2) the material inlet control assembly 18; (3) the screen agitator assembly 22; and (4) the augers 416, 242 and 106.

For the embodiment of the invention in FIGS. 1-3 and 28 and 29, the fluid flow assembly 20 is adjustable through the use of the fluid flow control assembly 352 so that the door members 369 are adjusted to the desired portion of openness. This will control the amount and volume of air flow therethrough so as to adjust the air flow through the material and debris separator assemblies.

Additionally, the screen agitator assembly 22 may be operated so as to regulate the frequency and amount of agitation to be transferred to the respective screen members 154, 176, 186, 230 and 236. This agitation may be adjusted through adjustment of the rocker linkage assemblies 182 or 295.

On operation of the granular material cleaner apparatus 12, it is obvious that the granular material must first be supplied at the inlet housing assembly 14. The metering roll 50 is to be adjusted such that the desired opening exists between plate 42 and the roll 50 itself to choke feed the granular material. Adjustment is accomplished by turning bolt 76 to move lever 70 either up or down. As the granular material is metered and/or choke fed through hopper 24, it initially engages the material inlet control assembly 18 which controls the speed and the amount of the granular material to enter. The material inlet control assembly 18 is provided with the rotating paddles 138 and brushes 136 which drag and scalp the heavier contaminants off the screen (i.e., scalp screen) 176 for discharge through scalp discharge spout 246.

The contaminated granular material falls through screen 150 and into the material flow channel assembly 16 as best shown in FIG. 10. The granular material is processed through the screen member 154 and filters therethrough so as to rest on the first screen member 154. The debris and foreign material contained with the contaminated granular material moves downwardly on top of the initial screen member 154. In this first stage, the contaminated granular material flows on the screen member 154 to move downwardly as shown by the arrow 159 into the first encounter with one of the material and debris separator assemblies. At this point, the finer material of the debris and foreign material falls through the screen members 154 whereupon they encounter the first intermediate top wall member 184 so as to move downwardly to the discharge channel 187 to move downwardly into the discharge housing assembly 28 and into auger housing 104. The granular material flows into the material and debris assembly whereupon it is directed by the grain door 172 downwardly into the intermediate support and filter assembly 160. At this point, the air flow is encountered from the fluid inlet opening 166 which moves through the fluid baffle assembly 162 (i.e., the grain door 172 and optionally the air door 174) so as to pick up the finer debris and foreign material and move the same therefrom into the fluid flow assembly 20.

Now the contaminated granular material is at the intermediate support and filter assembly 142 and moves onto the screen member 186 whereupon the finer debris filters through the screen member 186 downwardly on to the second intermediate top wall member 188. The debris on the wall member 188 moves outwardly into the channel portion for discharge therefrom. The granular contaminated material then moves downwardly into the second encounter with a material and debris separator assembly 160 which provides for the air separation of foreign material and debris from the granular material as previously described above. At this point, the contaminated granular material is moved downwardly on the second intermediate screen member 238, whereupon again the foreign material and debris filters through such screen member 238 to fall into the discharge support and filter assembly 144. The granular material then moves downwardly into the third material and debris separator assembly 148 which through the air flow therethrough operates to separate the debris and foreign material therefrom as previously described.

On moving into the discharge support and filter assembly 144, it is seen that the granular material therefrom is moved downwardly onto the discharge screen member 236 whereupon the finer and remaining debris thereupon is filtered through the subject screen member 236. The granular material is then moved downwardly into the final one of the material and debris separator assemblies 148 and through a discharge opening 240. The granular material moves downwardly under the force of gravity into the discharge housing assembly 28 and whereupon the cleansed granular material moves through the material discharge hopper. At this same point, the debris and foreign material has been collected and moved through the discharge hopper 26 to be separated therefrom. The augers 106 and 242 move the foreign material out of the housing assembly 14.

The screen agitator 190 may be used having the rocker brush assemblies 192 with the brush members 196 being periodically moveable in a reciprocating manner against the adjacent screen members so as to cleanse same and separate the granular material from the debris and foreign material.

The cyclone 402 receives air plus light contaminants via conduits 400, 406 and 408, and separates the same. The light contaminants are processed out through auger housing 420 and out of air lock 422.

Referring in detail now to FIG. 12, grain is fed in at the top of the inlet hopper A. This inlet hopper must be choke fed. The grain is then metered by adjusting bolt 76 onto the scalp screen 150. The heavier particles are then dragged by paddles 138 across the scalp screen 150 and are discharged at the scalp discharge spout 500. The grain itself and the fines are dropped through the scalp screen and begin to slide down #1 screen 154. As it drops from #1 screen 154 to #2 screen 186, air is drawn through the falling grain. The fines fall through the #1 screen 154 and slide down the screening pan to drop to the bottom of the cleaner. The screens are brushed 90 strokes a minute. The screen is held in place with a screen holddown 300. As the grain passes off #1 screen it will strike a grain plate 172. Behind the grain plate 172 is an air plate 174. The grain plate and the air plate are adjustable to obtain the desired aspiration. The grain then continues down screen #2 and drops from screen #2 to #3 screen 230. Again, the grain is aspirated. This also happens on screens #3 F3 and #4 screen 236. The grain is then discharged out the bottom of the cleaner.

There are various sizes of scalp screens and fines screens depending upon the amount of material to be removed from the product. The by-product can also be regulated by the speed or amount of flow out of the inlet hopper 34. As the adjusting bolt 76 is turned on the inlet hopper clockwise, the flow increases. The adjuster can be operated with the adjuster wrench.

The amount of aspirated material removed may be controlled by adjustmenet of the grain plate and/or air plate. It can also be regulated primarily by the air damper 450 on the cyclone discharge. This aspirated material should be monitored at the air lock 422.

Brushes on each screen aid in keeping the screen clean for maximum fines removal. However, the quality of some products may require the screens to be removed periodically and manually cleaned.

The flow is adjustable as it enters the cleaner. The large parts are scalped off, the grain falls upon the screens and cascades down the screens. The screens are kept clean by brushes, the air is regulated by the grain plate, air plate and the air damper. The aspirated material is monitored at the airlock auger. The fines are monitored at their auger discharge and the clean grain must be monitored.

All grains react similar in the apparatus 12. Corn, wheat, milo, soybeans, barley and similar grains are included in this section. The cleaner feed control hopper 8 will normally be set more open with coarse grains than with small grains. The opening of the feed hopper on coarse grains will run between 1½ and 4 inches open. On small grains between ½ and 2½ inches open. The opening of the feed hopper will control the amount of take-out on a given screen size. The amount of aspirated take-out will also depend on feed hopper opening. The grain plates H must be set so there is a "boil" of grain as it strikes the grain plate. The grain plates may also be used to control the speed of the grain running across the screen. The air plate I may be changed to regulate the speed of the air going through the grain cleaner. The air damper 450 may be changed to adjust the volume of the air running to the grain. The airlock should emit dust and flying particles as well as cracks and small grain. A few kernels of whole grain should be found in the aspirated material for maximum air efficiency. Screen sizes may be found in the section on recommended screen sizes. The amount of removal through the screens is determined by the amount of flow as well as screen size. Screens remove approximately 40% of by-product on screen #1, 30% on screen #2, 20% on screen #3, and 10% on screen #4. Screens may be mixed or matched or replaced by blanks.

In a new and novel process of this invention, the steps include (1) the initial supplying of contaminated granular material to be cleansed into the granular material cleaner apparatus 12 of this invention; (2) the controlled movement of the granular material through the material inlet control assembly 18; (3) moving the granular material into the first inlet support and filter assembly 140; (4) utilizing the material and debris separator assembly 148 having air flow therethrough to achieve a separation of the debris and foreign material from the contaminated granular material; (5) operating the screen agitator assembly 22 in order to agitate the screen members having granular material thereon to achieve separation of foreign material; (6) moving the granular maerial onto the intermediate support and filter assembly 142 to provide for further processing; (7) moving the granular material into the discharge support and filter assembly 144 which achieves the final separation through the use of air flow and agitation process; and (8) moving the cleansed granular material into the discharge housing assembly 28.

The process of this invention achieves a new and novel separation of granular material and the foreign particles contained therein with a minimum amount of energy required and the use of gravity in order to move the contaminated granular material therethrough.

The granular material cleaner apparatus of this invention is sturdy in construction, economical to manufacture, efficient in operation, and substantially maintenance free while achieving an efficient and effective cleansing of granular material through the simplified operation thereof.

While the present invention has been described herein with reference to particular embodiments thereof, a latitude of modification, various changes and substitutions are intended in the foregoing disclosure, and it will be appreciated that in some instances some features of the invention will be employed without a corresonding use of other features without departing from the scope of the invention as set forth.

We claim:

1. A granular material cleaning apparatus operable to receive a contaminated granular material which is to be cleaned, comprising:

(a) an upright container housing assembly;

(b) an inlet housing assembly pivotally connected to the upright container housing assembly to receive a contaminated granular material;

(c) a material inlet control assembly mounted to the upright container housing at an upper inlet portion thereof;

(d) a discharge housing assembly mounted to the upright container housing assembly;

(e) a material flow channel assembly mounted within said container housing assembly generally underneath said material inlet control assembly to initially receive the contaminated granular material at an upper end thereof and pass the same under gravity moving transversely on said material flow channel assembly until discharged into said discharge housing assembly;

(f) a fluid flow assembly mounted on the upright container housing and in communication with the inside of said upright container housing and operably to supply air flow therein;

(g) a screen agitator assembly including a screen and mounted on the upright container housing and operably engaged to the material flow channel assembly;

(h) a cyclone member communicating with said fluid flow assembly and having an open bottom;

(i) a cyclone auger communicating with said open bottom of said cyclone member and having a cyclone auger end;

(j) an air-lock box communicating with said cyclone auger end and having a weighted plate member pivotally connected therewith; and said inlet housing assembly comprises a hopper member pivotally connected to the container housing assembly by a linkage assembly; said linkage assembly comprises a shaft rotatably supported by said container housing, a lever pivotally mounted to said shaft and an adjustment bolt assembly affixed to said hopper member and engaged to said lever; said hopper member having a structure defining a pair of opposed longitudinal slots; a metering roll rotatably disposed in said slots and having one end resting against said lever and having another end coupled to a means for rotating the metering roll; said hopper member having an upper downwardly sloping rectangular shaped flange member and a lower downwardly sloping rectangular shaped flange member, each terminating in a spaced relationship with respect to each other to define an opening wherethrough said contaminated granular material to be cleaned passes; said metering roll disposed in said opening and the position of said metering roll over the opening being adjusted by said linkage assembly.

2. The apparatus of claim 1 wherein said discharge housing assembly comprises a debris discharge auger assembly including a debris discharge auger housing having an auger rotatably lodged therein to receive heavy contaminants from within the container housing assembly.

3. The apparatus of claim 2 wherein said material inlet control assembly comprises an endless belt means rotatably supported by said upright container housing assembly; a means, engaged to said endless belt means, for moving said endless belt means; at least one brush secured to said endless belt means; and at least one paddle connected to said endless belt means.

4. The apparatus of claim 3 wherein said upright container housing assembly comprises a separator container housing assembly supported by said upright container housing assembly and containing said material flow channel assembly; said material flow channel assembly includes a first inlet support and filter assembly, an intermediate support and filter assembly having a first intermediate top wall member, and a discharge support and filter assembly.

5. The apparatus of claim 4 wherein aid first inlet support and filter assembly includes a material direction and control assembly and a material and debris separator assembly, aid material direction and control assembly includes a first screen assembly supported on a support and containment frame that is supported by said separator housing assembly, and a second screen member, said first screen assembly comprises a first grid member which initially receives granular material thereon, and said second screen member includes a second grid member adapted to receive granular material with its foreign particles therewith which has just passed through the first screen member with the remaining granular material including debris therein moving downwardly into said intermediate support and filter assembly; and said material and debris separator assembly comprises a fluid inlet assembly supported by said separator container housing assembly, a fluid baffle assembly supported by said separator container housing assembly, and a fluid discharge assembly supported by said separator container housing assembly, air fluid inlet assembly including an air chamber including an air inlet opening and an outlet opening, said inlet opening being addressed to received outside air from the outside of said upright container housing assembly and pass same through said outlet opening defined by a merging point of the second grid member and the first intermediate top wall member.

6. The apparatus of claim 5 wherein said fluid baffle assembly includes a grain door pivotally supported by said upright container housing assembly to define a grain opening between aid merging point and same and adaptable to be pivoted towards the flow of granular material to lessen the grain opening between the grain door and the merging point, said fluid baffle assembly additionally comprising an air door pivotally supported by said upright container housing assembly in proximity to said grain door and adaptable to be pivoted towards and away from the grain door.

7. The apparatus of claim 6 additionally comprising a cylindrical lug secured to said weighted plate where around weights may be added to further weight the weighted plate.

8. The apparatus of claim 7 additionally comprising at least one weight member removably secured to said cylindrical lug.

9. A process for removing foreign material from a contaminated granular material utilizing a granular material cleaning apparatus, comprising:

(a) providing a flow of contaminated granular material through an upper end of a container housing assembly of said granular material cleaning apparatus;

(b) moving said contaminated granular material downwardly within said container housing assembly through a material flow assembly having a plurality of spaced inclined screen members;

(c) periodically agitating said screen members to aid in the separation of the foreign material from the contaminated granular material;

(d) periodically moving said contaminated granular material vertically while processing an air flow therethrough to lift up and remove the lighter foreign material therefrom;

(e) controlling the flow of contaminated granular material through the cleaning apparatus with at least one grain door;

(f) controlling eh air flow through the cleaning apparatus with at least one air door that is pivoted within the cleaning apparatus in close proximity to said grain door such as to be capable of being pivoted towards and away from said grain door;

(g) removing lighter foreign material and air flow from the cleaning apparatus and passing the same into a cyclone separator member wherein the lighter foreign material are separated from the air;

(h) flowing the lighter foreign material away from the cyclone separator member and into an air-lock box;

(i) controlling eh flow of lighter foreign material from the air-lock box; and (j) separating at a discharge housing assembly of said container housing assembly the initial contaminated granular material into a cleansed material discharge hopper and a debris discharge hopper to convey the foreign and undesirable material therefrom.

10. The process of claim 9 wherein said controlling step (i) comprises pivoting a weighted plate member to the air-lock box such that the same comes in contact with the lighter foreign material.

11. The process of claim 10 additionally comprising adding at least one weight to the weighted plate member.

* * * * *